US012575608B2

(12) United States Patent
Batley et al.

(10) Patent No.: US 12,575,608 B2
(45) Date of Patent: Mar. 17, 2026

(54) HEATING SYSTEM FOR VAPORIZABLE MATERIAL INSERT

(71) Applicant: JUUL Labs, Inc., San Francisco, CA (US)

(72) Inventors: Oliver J. Batley, Cambridge (GB); Simon Burge, Ely (GB); Ian Garcia-Doty, Oakland, CA (US); Xenofon Kalogeropoulos, Cambridge (GB); Alexander R. Mauchle, Milton Keynes (GB); Andrew D. Newbold, Ixworth (GB); Simon J. Smith, Hertford (GB); Paul R. Vieira, Oakland, CA (US)

(73) Assignee: JUUL Labs, Inc., Washington, DC (US)

( * ) Notice: Subject to any disclaimer, the term of this patent is extended or adjusted under 35 U.S.C. 154(b) by 379 days.

(21) Appl. No.: 17/843,742

(22) Filed: Jun. 17, 2022

(65) Prior Publication Data

US 2022/0322742 A1 Oct. 13, 2022

Related U.S. Application Data

(63) Continuation of application No. PCT/US2020/065685, filed on Dec. 17, 2020.
(Continued)

(30) Foreign Application Priority Data

Dec. 17, 2019 (GR) ..... 20190100562

(51) Int. Cl.
*A24F 40/46* (2020.01)
*A24F 40/10* (2020.01)
(Continued)

(52) U.S. Cl.
CPC ..... *A24F 40/46* (2020.01); *A24F 40/10* (2020.01); *A24F 40/20* (2020.01); *A24F 40/42* (2020.01)

(58) Field of Classification Search
None
See application file for complete search history.

(56) References Cited

U.S. PATENT DOCUMENTS 3,373,915 A 3/1968 Anderson et al.
3,559,655 A 2/1971 Briskin et al.
(Continued)

FOREIGN PATENT DOCUMENTS

CA 3010559 A1 7/2017
CN 102753047 A 10/2012
(Continued)

OTHER PUBLICATIONS

"Property Tables and Charts (SI Units), 2015, Wright State University, p. 13" (Year: 2015).*
(Continued)

*Primary Examiner* — Russell E Sparks
(74) *Attorney, Agent, or Firm* — Mintz, Levin, Cohn, Ferris, Glovsky and Popeo, P.C.

(57) ABSTRACT

Various embodiments of a system for generating an inhalable aerosol are described. In some embodiments, the system includes a vaporizer device with a heating system configured to heat a vaporizable material insert. The heating system can include a heating element positioned adjacent a vaporizable material compartment configured to receive the vaporizable material insert. The heating system can include a compression plate configured to press the vaporizable material insert against the heating element. The heating system can include an airflow pathway extending along the vaporizable material compartment. Various embodiments of
(Continued)

vaporizer material inserts that can be included and used with the system are also described. Related systems, methods, and articles of manufacture are also described.

16 Claims, 14 Drawing Sheets

Related U.S. Application Data

(60) Provisional application No. 62/953,004, filed on Dec. 23, 2019.

(51) Int. Cl.
*A24F 40/20* (2020.01)
*A24F 40/42* (2020.01)

(56) References Cited

U.S. PATENT DOCUMENTS 3,584,631 A 6/1971 Halter et al.
3,828,799 A 8/1974 Beam
4,079,742 A 3/1978 Rainer et al.
4,708,151 A 11/1987 Shelar
5,042,509 A 8/1991 Banerjee et al.
5,065,776 A 11/1991 Lawson et al.
5,249,586 A 10/1993 Morgan et al.
5,479,948 A 1/1996 Counts et al.
7,726,320 B2 6/2010 Robinson et al.
8,490,629 B1 7/2013 Shenassa et al.
8,671,952 B2 3/2014 Winterson et al.
8,869,792 B1 10/2014 Lee
8,991,402 B2 3/2015 Bowen et al.
9,408,416 B2 8/2016 Monsees et al.
9,603,389 B2 * 3/2017 Chen ..... A24F 40/485
9,943,114 B2 4/2018 Batista
10,512,285 B2 * 12/2019 Kuczaj ..... A24F 40/53
10,729,179 B2 8/2020 Atkins et al.
11,129,414 B2 9/2021 Atkins et al.
11,147,128 B2 10/2021 Qiu
11,197,497 B2 * 12/2021 Lee ..... A24F 40/65
11,464,082 B2 10/2022 Bowen et al.
11,700,874 B2 7/2023 Alizon et al.
12,010,782 B2 6/2024 Horrod et al.
12,156,538 B2 * 12/2024 Leah ..... A24F 40/53
2004/0055613 A1 3/2004 Horian
2005/0268911 A1 12/2005 Cross et al.
2006/0032501 A1 2/2006 Hale et al.
2007/0221234 A1 9/2007 Beckstead
2007/0283972 A1 12/2007 Monsees et al.
2008/0092912 A1 4/2008 Robinson et al.
2009/0126746 A1 5/2009 Strickland et al.
2009/0151717 A1 6/2009 Bowen et al.
2009/0260642 A1 10/2009 Monsees et al.
2010/0024834 A1 2/2010 Oglesby et al.
2011/0041861 A1 2/2011 Sebastian et al.
2011/0226236 A1 9/2011 Buchberger
2011/0290267 A1 12/2011 Yamada et al.
2013/0042865 A1 2/2013 Monsees et al.
2014/0301721 A1 10/2014 Ruscio et al.
2014/0338683 A1 * 11/2014 Liu ..... A24F 40/40 131/329
2014/0366898 A1 12/2014 Monsees et al.
2015/0272218 A1 10/2015 Chen
2015/0335070 A1 11/2015 Sears et al.
2016/0073692 A1 3/2016 Alarcon et al.
2016/0120222 A1 5/2016 Bagai et al.
2016/0120225 A1 5/2016 Mishra et al.
2016/0120227 A1 5/2016 Levitz et al.
2016/0295922 A1 10/2016 John et al.
2016/0309782 A1 10/2016 Malgat et al.
2016/0309789 A1 10/2016 Thomas, Jr.
2016/0338412 A1 11/2016 Monsees et al.
2017/0035116 A1 2/2017 Batista
2017/0055575 A1 3/2017 Wilke et al.
2017/0055580 A1 3/2017 Blandino et al.
2017/0071250 A1 3/2017 Mironov et al.
2017/0143041 A1 5/2017 Batista et al.
2017/0156403 A1 6/2017 Gill et al.
2017/0164657 A1 6/2017 Batista
2017/0203057 A1 7/2017 Buchberger
2017/0333650 A1 11/2017 Buchberger et al.
2018/0027877 A1 2/2018 Tucker et al.
2018/0027883 A1 * 2/2018 Zuber ..... H05B 6/108
2018/0084823 A1 3/2018 Fuisz et al.
2018/0110263 A1 4/2018 Borkovec et al.
2018/0132534 A1 5/2018 Reevell
2018/0177233 A1 6/2018 Tucker et al.
2018/0228216 A1 8/2018 Saygili
2018/0295881 A1 10/2018 Mironov et al.
2018/0325179 A1 11/2018 Li et al.
2018/0343917 A1 12/2018 Sutton et al.
2019/0001077 A1 1/2019 Xu et al.
2019/0037921 A1 2/2019 Kennedy et al.
2019/0098930 A1 4/2019 Fallon et al.
2019/0124982 A1 5/2019 Atkins et al.
2019/0166913 A1 6/2019 Trzecieski
2019/0191769 A1 6/2019 Qiu
2019/0200674 A1 7/2019 Tucker et al.
2019/0200677 A1 7/2019 Chong et al.
2019/0208827 A1 7/2019 Mironov et al.
2020/0093181 A1 3/2020 Hubbard et al.
2020/0107585 A1 4/2020 Atkins et al.
2020/0113245 A1 4/2020 Rosser et al.
2020/0120993 A1 4/2020 Atkins et al.
2020/0196676 A1 6/2020 Zhu
2020/0324066 A1 10/2020 Potter
2021/0030073 A1 2/2021 Yang et al.
2021/0186113 A1 6/2021 Lee
2021/0244103 A1 8/2021 Courbat et al.
2021/0321672 A1 10/2021 Wilke et al.
2021/0386120 A1 12/2021 Gill
2022/0030953 A1 2/2022 Woods et al.
2022/0046997 A1 2/2022 Atkins et al.
2022/0095685 A1 3/2022 Atkins et al.
2022/0104550 A1 4/2022 Mao et al.
2022/0117306 A1 4/2022 Na et al.
2022/0151285 A1 5/2022 Garcia-Doty
2022/0160040 A1 5/2022 Zhang et al.
2022/0183374 A1 6/2022 Thorsen
2022/0240586 A1 8/2022 Batista et al.
2022/0295894 A1 * 9/2022 Batista ..... A24F 40/465
2022/0354182 A1 11/2022 Courbat et al.
2023/0055093 A1 2/2023 Ki et al.
2023/0309615 A1 10/2023 Mauchle et al.
2024/0090576 A1 3/2024 Batista et al.

FOREIGN PATENT DOCUMENTS

CN 103783674 A 5/2014
CN 104095291 A 10/2014
CN 105764367 A 7/2016
CN 106307622 A 1/2017
CN 106572705 A 4/2017
CN 106659247 A 5/2017
CN 106659250 A 5/2017
CN 106858726 A 6/2017
CN 107772540 A 3/2018
CN 111432670 A 7/2020
CN 113163855 A 7/2021
EP 2394520 A1 12/2011
EP 3420829 A1 1/2019
EP 3664631 A2 6/2020
EP 3795009 A1 3/2021
EP 3829366 B1 7/2024
GB 2527597 A 12/2015
GB 2547699 A 8/2017
GB 2568411 B 8/2019
JP S5138499 A 3/1976
JP 2001-507576 A 6/2001
JP 2010506594 A 3/2010
JP 2010517568 A 5/2010
JP 2010178730 A 8/2010
JP 2013516159 A 5/2013

(56) References Cited

FOREIGN PATENT DOCUMENTS

| | | | | |
|---|---|---|---|---|
| JP | 2015-509709 | A | 4/2015 | |
| JP | 2016538847 | A | 12/2016 | |
| JP | 2016538850 | A | 12/2016 | |
| JP | 2017018146 | A | 1/2017 | |
| JP | 2017520263 | A | 7/2017 | |
| JP | 2017-529896 | A | 10/2017 | |
| JP | 2017529848 | A | 10/2017 | |
| JP | 2017533732 | A | 11/2017 | |
| JP | 2020536536 | A | 12/2020 | |
| KR | 20-2012-0008751 | U | 12/2012 | |
| KR | 10-2016-0112769 | A | 9/2016 | |
| KR | 10-2021-0155091 | A | 12/2021 | |
| RU | 2602053 | C2 | 11/2016 | |
| RU | 2604313 | C2 | 12/2016 | |
| RU | 2629878 | C1 | 9/2017 | |
| RU | 2655239 | C2 | 5/2018 | |
| WO | WO-2006120570 | A2 | 11/2006 | |
| WO | WO-2011079932 | A1 | 7/2011 | |
| WO | WO-2013060743 | A2 * | 5/2013 | ..... A24B 15/167 |
| WO | WO-2015082651 | A1 | 6/2015 | |
| WO | WO-2015155289 | A1 * | 10/2015 | ..... A24F 47/008 |
| WO | WO-2015177045 | A1 | 11/2015 | |
| WO | WO-2015179388 | A1 | 11/2015 | |
| WO | WO-2016005533 | A1 | 1/2016 | |
| WO | WO-2016062777 | A1 | 4/2016 | |
| WO | WO-2016079589 | A1 | 5/2016 | |
| WO | WO-2016162446 | A1 | 10/2016 | |
| WO | WO-2017072148 | A1 | 5/2017 | |
| WO | WO-2017122196 | A1 | 7/2017 | |
| WO | WO-2017129617 | A1 | 8/2017 | |
| WO | WO-2017207418 | A1 | 12/2017 | |
| WO | WO-2017207419 | A1 | 12/2017 | |
| WO | WO-2017207582 | A1 | 12/2017 | |
| WO | WO-2018019578 | A1 | 2/2018 | |
| WO | WO-2018041065 | A1 | 3/2018 | |
| WO | WO-2018041924 | A1 | 3/2018 | |
| WO | WO-2018122389 | A1 | 7/2018 | |
| WO | WO-2018122978 | A1 | 7/2018 | |
| WO | WO-2018206615 | A2 | 11/2018 | |
| WO | WO-2019057942 | A1 | 3/2019 | |
| WO | WO-2019073237 | A1 | 4/2019 | |
| WO | WO-2019088562 | A2 | 5/2019 | |
| WO | WO-2019122015 | A1 | 6/2019 | |
| WO | WO-2020028591 | A1 | 2/2020 | |
| WO | WO-2020157814 | A1 | 8/2020 | |
| WO | WO-2020239599 | A1 | 12/2020 | |

OTHER PUBLICATIONS

Guo, et al. (Mar. 31, 2016) "Heat Transfer Performance of Atomizer of Electronic Cigar", Popular Science and Technology, 18(3):52-54.

* cited by examiner

HEATING SYSTEM FOR VAPORIZABLE MATERIAL INSERT

CROSS-REFERENCE TO RELATED APPLICATION

This application is a bypass continuation and claims priority to PCT/US20/65685, filed on Dec. 17, 2020 and entitled "Heating System for Vaporizable Material Insert" which claims priority to Greek patent application No. 20190100562, filed on Dec. 17, 2019, entitled "Saddle Bags" and U.S. Provisional Patent Application Ser. No. 62/953,004, filed on Dec. 23, 2019, entitled "Heating System for Vaporizable Material Insert", the entire contents of which are hereby expressly incorporated herein by reference.

TECHNICAL FIELD

The subject matter described herein relates to vaporizer devices including a heating system for heating a vaporizable material insert.

BACKGROUND

Vaporizer devices, which can also be referred to as vaporizers, electronic vaporizer devices, or e-vaporizer devices, can be used for delivery of an aerosol (for example, a vapor-phase and/or condensed-phase material suspended in a stationary or moving mass of air or some other gas carrier) containing one or more active ingredients by inhalation of the aerosol by a user of the vaporizing device. For example, electronic nicotine delivery systems (ENDS) include a class of vaporizer devices that are battery powered and that can be used to simulate the experience of smoking, but without burning of tobacco or other substances. Vaporizers are gaining increasing popularity both for prescriptive medical use, in delivering medicaments, and for consumption of tobacco, nicotine, and other plant-based materials. Vaporizer devices can be portable, self-contained, and/or convenient for use.

In use of a vaporizer device, the user inhales an aerosol, colloquially referred to as "vapor," which can be generated by a heating element that vaporizes (e.g., causes a liquid or solid to at least partially transition to the gas phase) a vaporizable material, which can be liquid, a solution, a solid, a paste, a wax, and/or any other form compatible for use with a specific vaporizer device. The vaporizable material used with a vaporizer can be provided within a cartridge for example, a separable part of the vaporizer device that contains vaporizable material) that includes an outlet (for example, a mouthpiece) for inhalation of the aerosol by a user.

To receive the inhalable aerosol generated by a vaporizer device, a user may, in certain examples, activate the vaporizer device by taking a puff, by pressing a button, and/or by some other approach. A puff as used herein can refer to inhalation by the user in a manner that causes a volume of air to be drawn into the vaporizer device such that the inhalable aerosol is generated by a combination of the vaporized vaporizable material with the volume of air.

An approach by which a vaporizer device generates an inhalable aerosol from a vaporizable material involves heating the vaporizable material in a vaporization chamber (e.g., a heater chamber) to cause the vaporizable material to be converted to the gas (or vapor) phase. A vaporization chamber can refer to an area or volume in the vaporizer device within which a heat source (for example, a conductive, convective, and/or radiative heat source) causes heating of a vaporizable material to produce a mixture of air and vaporized material to form a vapor for inhalation of the vaporizable material by a user of the vaporization device.

Vaporizer devices can be controlled by one or more controllers, electronic circuits (for example, sensors, heating elements), and/or the like on the vaporizer. Vaporizer devices can also wirelessly communicate with an external controller for example, a computing device such as a smartphone).

In some embodiments, vaporizer cartridges configured to heat solid vaporizable material (e.g. plant material such as tobacco leaves and/or parts of tobacco leaves) can require higher temperatures for inner tobacco regions to reach a minimum required temperature for vaporization. As a result, the solid vaporizable material can become burned at these high peak temperatures and produce toxic byproducts (e.g., chemical elements or chemical compounds).

Vaporizer devices can be categorized into two classes, those that heat through conduction and those that heat through convection. For example, conduction-based vaporizer devices may be configured to vaporize liquid vaporizable material using a heating element contacting the liquid vaporizable material. As such, the liquid vaporizable material may contaminate the heating element, which can compromise performance of the vaporizer device. Some vaporizers may incorporate the heating element into the disposable part of the vaporizer device (e.g., the cartridge), such that the heating element may be replaced with each new cartridge and thereby limit, but not eliminate, heating element contamination. However, this can increase manufacturing labor and costs associated with the disposable. Furthermore, uniform heating of the vaporizable material in current conduction-based vaporizers may be difficult to achieve due to the low thermal conductivity of certain vaporizable materials (e.g., plant materials, such as tobacco).

Some issues with current vaporizer devices include the inability to efficiently and effectively heat the vaporizable material without wasting a significant amount of energy. For example, some vaporizer devices include a heater body wrapped around an external surface of a tobacco material and placed directly in an airstream. Such a configuration may cause one or more heater surfaces to be exposed to the airstream, thereby losing at least a portion of thermal energy produced by the heater that could have been used to heat the tobacco material. As such, energy may be wasted as the generated heat is not effectively utilized.

Vaporizer devices configured to bury the heater inside of the tobacco material may include airflow passing through the tobacco material thereby prohibiting tight tobacco compaction around the heater, thus diminishing heat transfer from the heater to the tobacco material. Furthermore, vaporizer devices with the heater buried inside the tobacco may also experience cleaning and hygiene issues. For example, as the heater pierces the tobacco, residue may be left on the heater after use, thereby requiring the user to clean the heater before continued use.

SUMMARY

Aspects of the current subject matter relate to vaporizer devices including various embodiment of a heating system for heating a vaporizable material insert and generating an inhalable aerosol. In one aspect, a heating system of a vaporizer device is described for generating an inhalable aerosol. The heating system can include a heating element positioned along a vaporizable material insert receptacle configured to receive a vaporizable material insert. The heating element can be configured to heat the vaporizable material insert for generating the inhalable aerosol. The heating system can include a compression element positioned along a part of the vaporizable material insert receptacle for pressing the vaporizable material insert against the heating element. The heating system can further include an airflow pathway extending along the vaporizable material insert receptacle for allowing the inhalable aerosol to flow through an outlet of the vaporizer device.

In some variations one or more of the following features can optionally be included in any feasible combination. In some embodiments, the vaporizable material insert receptacle can include two channels extending along opposing sides of the heating element, and each of the two channels can be configured to receive a vaporizable material insert. The heating element can include a first side configured to contact and heat a first vaporizable material insert, and the heating element can include a second side configured to contact and heat a second vaporizable material insert. The compression element can include a plurality of extensions configured to apply pressure against the vaporizable material insert. The airflow pathway can include a part that extends between at least two of the plurality of extensions. The heating system can further include a spring that applies a spring force against the compression element to assist with pressing the vaporizable material insert against the heating element. The heating system can further include an insulation layer positioned adjacent a first side of the heating element, and the first side of the heating element can be opposed to a second side of the heating element defining a part of the vaporizable material insert receptacle. The heating element can include a helical configuration that is configured to receive a vaporizable material insert having a cylindrical shape.

In some embodiments, the heating system can further include a compression adjusting feature that can allow an amount of compression force provided by the compression element to be adjusted. The compression element can include a pair of jaws that are moveable to compress and heat the vaporizable material positioned between the pair of jaws. The heating element can include a flexible material configured to conform to the vaporizable material insert when the vaporizable material insert is pressed against the heating element. The compression element can extend from a lid that transitions between an open and closed configuration, and the compression element can be configured to press the vaporizable material insert against the flexible material of the heating element when the lid is in the closed configuration. The flexible material can be coupled to a movable feature that, as a result of the lid forming the closed configuration, moves to cause an increase in surface area contact between the heating element and the vaporizable material insert. The vaporizable material insert can include an insert housing that contains a vaporizable material.

In another aspect, a vaporizer system for generating an inhalable aerosol is described. For example, the vaporizer system can include a vaporizable material insert including a vaporizable material and a vaporizer device. The vaporizer device can include a heating system that includes a heating element positioned along a vaporizable material insert receptacle configured to receive the vaporizable material insert. The heating element can be configured to heat the vaporizable material insert for generating the inhalable aerosol. The heating system can further include a compression element positioned along a part of the vaporizable material insert receptacle for pressing the vaporizable material insert against the heating element. The heating element can also include an airflow pathway extending along the vaporizable material insert receptacle for allowing the inhalable aerosol to flow through an outlet of the vaporizer device.

In some variations one or more of the following features can optionally be included in any feasible combination. In some embodiments, the vaporizable material insert receptacle can include two channels extending along opposing sides of the heating element, and each of the two channels can be configured to receive a vaporizable material insert. The heating element can include a first side configured to contact and heat a first vaporizable material insert, and the heating element can include a second side configured to contact and heat a second vaporizable material insert. The compression element can include a plurality of extensions configured to apply pressure against the vaporizable material insert. In some embodiments, a part of the airflow pathway can extend between at least two of the plurality of extensions. The heating system can further include a spring that applies a spring force against the compression element to assist with pressing the vaporizable material insert against the heating element. The heating system can further include an insulation layer positioned adjacent a first side of the heating element, and the first side of the heating element can be opposed to a second side of the heating element defining a part of the vaporizable material insert receptacle. The heating element can include a helical configuration that is configured to receive a vaporizable material insert having a cylindrical shape.

In some embodiments, the heating system can further include a compression adjusting feature that allows an amount of compression force provided by the compression element to be adjusted. The compression element can include a pair of jaws that are moveable to compress and heat the vaporizable material positioned between the pair of jaws. The heating element can include a flexible material configured to conform to the vaporizable material insert when the vaporizable material insert is pressed against the heating element. The compression element can extend from a lid that transitions between an open and closed configuration. The compression element can be configured to press the vaporizable material insert against the flexible material of the heating element when the lid is in the closed configuration. The flexible material can be coupled to a movable feature that, as a result of the lid forming the closed configuration, moves to cause an increase in surface area contact between the heating element and the vaporizable material insert. The vaporizable material insert can include an insert housing that contains a vaporizable material. The vaporizable material of the vaporizable material insert can include a liquid vaporizable material. The vaporizable material insert can include at least one of a tobacco material and a non-liquid vaporizable material. The vaporizable material insert can include a filter portion. The vaporizable material can include a plurality of perforations. The vaporizable material insert can include an integrated heating element.

In another interrelated aspect of the current subject matter, a method for generating an inhalable aerosol for inhalation by a user is described. The method can include receiving a vaporizable material insert including a vaporizable material into a vaporizable material insert receptacle of a vaporizer device. The method can further include compressing the vaporizable material insert against a heating element positioned along the vaporizable material insert receptacle. In addition, the method can include activating the heating element to heat the vaporizable material of the vaporizable material insert to form the inhalable aerosol.

In some variations one or more of the following features can optionally be included in any feasible combination. For example, the compressing can be performed by a compression element of the vaporizer device. The method can further include adjusting a compression force provided by the compression element. The vaporizer device can include a spring that applies the compression force against the compression element. The vaporizer device can include a compression adjusting feature that adjusts the compression force. The compression element can include a pair of movable jaws. The compression element can include a plurality of extensions configured to apply pressure against the vaporizable material insert. In some embodiments, a part of an airflow pathway extends between at least two of the plurality of extensions. In some embodiments, the heating element can include a helical configuration that is configured to receive a vaporizable material insert having a cylindrical shape. The heating element can include a flexible material that conforms to the vaporizable material insert. The vaporizer device can further include an insulation layer positioned adjacent a first side of the heating element, the first side of the heating element can be opposed to a second side of the heating element defining a part of the vaporizable material insert receptacle. The method can further include forming at least one perforation along an insert housing of the vaporizable material insert.

The details of one or more variations of the subject matter described herein are set forth in the accompanying drawings and the description below. Other features and advantages of the subject matter described herein will be apparent from the description and drawings, and from the claims. The claims that follow this disclosure are intended to define the scope of the protected subject matter.

BRIEF DESCRIPTION OF THE DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Figure 1:
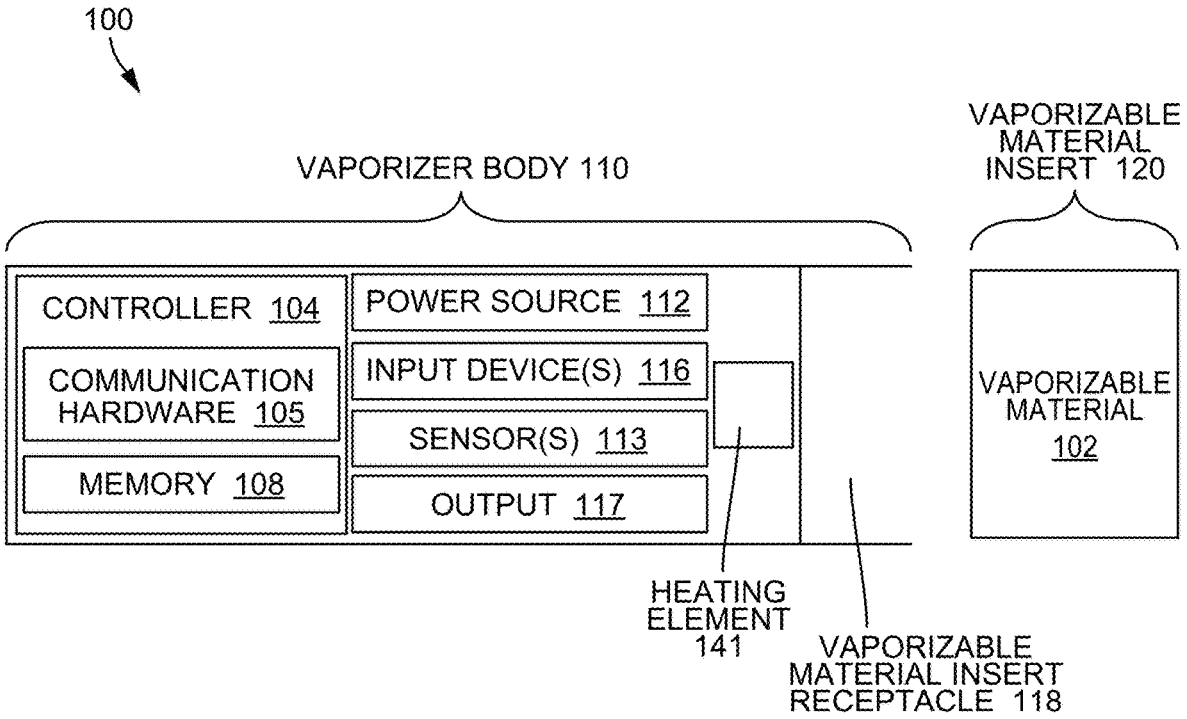
FIG. 1 illustrates a block diagram of a vaporizer device, consistent with implementations of the current subject matter.

Implementations of the current subject matter include methods, apparatuses, articles of manufacture, and systems relating to vaporization of one or more materials for inhalation by a user. For example, various embodiments of a heating system of a vaporizable device are described herein that provide a number of benefits, including increasing contact between a heating element of the heating system and a vaporizable material containing vaporizable material to ensure efficient and effective thermal transfer between the heating element and vaporizable material. For example, in some embodiments the heating system may be configured to counteract expansion of the heating element (e.g., apply at least an equal and opposite direction of force against the heating element) as the temperature increases, thereby ensuring the heating element maintains intimate contact with the vaporizable material insert during heating. Such maintained intimate contact between the heating element and the vaporizable material insert may reduce thermal loss, such as to a surrounding housing of the heating system, as well as increase heating efficiency (e.g., per amount of power consumption).

Various embodiments of a vaporizable material insert including vaporizable material for use with the various heating systems are also described. In some embodiments, the vaporizable material insert can be configured such that the vaporizable material can be placed in direct contact with and/or in close proximity to a heating element of the heating system to allow for efficient and effective heat transfer from the heating element to the vaporizable material. As such, the heating systems and vaporizable material inserts described herein can provide more efficient heating of vaporizable material and formation of inhalable aerosol compared to some currently available vaporizer devices and/or vaporizable material inserts. Other benefits are described herein and are within the scope of this disclosure.

The term "vaporizer device" as used in the following description and claims refers to any of a self-contained apparatus, an apparatus that includes two or more separable parts (for example, a vaporizer body that includes a battery and other hardware, and a cartridge or insert that includes a vaporizable material), and/or the like. A "vaporizer system," as used herein, can include one or more components, such as a vaporizer device. Examples of vaporizer devices consistent with implementations of the current subject matter include electronic vaporizers, electronic nicotine delivery systems (ENDS), and/or the like. In general, such vaporizer devices are hand-held devices that heat (such as by convection, conduction, radiation, and/or some combination thereof) a vaporizable material to provide an inhalable dose of the material.

The vaporizable material used with a vaporizer may optionally be provided within a vaporizable material insert or cartridge (e.g., a part of the vaporizer that contains the vaporizable material) which can be refillable when empty, or disposable such that a new cartridge containing additional vaporizable material of a same or different type can be used. A vaporizer device can be a cartridge-using vaporizer device, a cartridge-less vaporizer device, or a multi-use vaporizer device capable of use with or without a cartridge. Some cartridge embodiments can include a vaporizable material insert. For example, embodiments of vaporizable material inserts can be at least partly made of a non-liquid vaporizable material. As such, some embodiments of the vaporizer device can be configured to receive a vaporizable material insert that is at least partly made of one or more vaporizable materials for heating and forming an inhalable aerosol, as will be described in greater detail below. In some embodiments, a vaporizer device can include a heating chamber or compartment (e.g., a vaporizable material insert receptacle) configured to receive a vaporizable material insert directly therein and heat the vaporizable material insert for forming an inhalable aerosol.

In some implementations, a vaporizer device can be configured for use with a liquid vaporizable material (for example, a carrier solution in which an active and/or inactive ingredient(s) are suspended or held in solution, or a liquid form of the vaporizable material itself) and/or a non-liquid vaporizable material (e.g., a paste, a wax, a gel, a solid, a plant material, and/or the like). A non-liquid vaporizable material can include a plant material that emits some part of the plant material as the vaporizable material (for example, some part of the plant material remains as waste after the material is vaporized for inhalation by a user) or optionally can be a solid form of the vaporizable material itself, such that all of the solid material can eventually be vaporized for inhalation. A liquid vaporizable material can likewise be capable of being completely vaporized, or can include some portion of the liquid material that remains after all of the material suitable for inhalation has been vaporized.

FIG. 1 depicts a block diagram illustrating an example of a vaporizer device 100 consistent with implementations of the current subject matter. Referring to FIG. 1, the vaporizer device 100 can include a power source 112 (for example, a battery, which can be a rechargeable battery), and a controller 104 (for example, a processor, circuitry, etc. capable of executing logic) for controlling delivery of heat from a heating element 141 to cause a vaporizable material 102 of a vaporizable material insert 120 to be converted from a condensed form (such as a solid, a liquid, a solution, a suspension, a part of an at least partially unprocessed plant material, etc.) to the gas phase. The controller 104 can be part of one or more printed circuit boards (PCBs) consistent with certain implementations of the current subject matter.

After conversion of the vaporizable material 102 to the gas phase, at least some of the vaporizable material 102 in the gas phase can condense to form particulate matter in at least a partial local equilibrium with the gas phase as part of an aerosol, which can form some or all of an inhalable dose provided by the vaporizer device 100 during a user's puff or draw on the vaporizer device 100. It should be appreciated that the interplay between gas and condensed phases in an aerosol generated by a vaporizer device 100 can be complex and dynamic, due to factors such as ambient temperature, relative humidity, chemistry, flow conditions in airflow paths (both inside the vaporizer and in the airways of a human or other animal), and/or mixing of the vaporizable material 102 in the gas phase or in the aerosol phase with other air streams, which can affect one or more physical parameters of an aerosol. In some vaporizer devices, and particularly for vaporizer devices configured for delivery of volatile vaporizable materials, the inhalable dose can exist predominantly in the gas phase (for example, formation of condensed phase particles can be very limited).

The heating element 141 can include one or more of a conductive heater, a radiative heater, and/or a convective heater. One type of heating element is a resistive heating element, which can include a material (such as a metal or alloy, for example a nickel-chromium alloy, or a non-metallic resistor) configured to dissipate electrical power in the form of heat when electrical current is passed through one or more resistive segments of the heating element. In some implementations of the current subject matter, the heating element 141 (e.g., a resistive heating element and/or the like) is configured to generate heat for vaporizing the vaporizable material 102 to generate an inhalable dose of the vaporizable material 102. As noted, the vaporizable material 102 may be a liquid or non-liquid (or combination of both liquid and non-liquid). For example, the heating element 141 may be wrapped around, pressed into thermal contact with, or otherwise arranged to deliver heat to the vaporizable material 102 to be vaporized for subsequent inhalation by a user in a gas and/or a condensed (for example, aerosol particles or droplets) phase.

In some embodiments, the vaporizable material 102 may be a non-liquid vaporizable material including, for example, a solid-phase material (such as a gel, a wax, or the like) or plant material (e.g., tobacco leaves and/or parts of tobacco leaves). Where the vaporizable material 102 is a non-liquid vaporizable material, the heating element 141 can be part of, or otherwise incorporated into or in thermal contact with, the walls of a heating chamber or compartment (e.g., vaporizable material insert receptacle 118) into which the vaporizable material insert 120 is placed. Alternatively, the heating element 141 can be used to heat air passing through or past the vaporizable material insert 120, to cause convective heating of the vaporizable material 102 of the vaporizable material insert 120. In still other examples, the heating element 141 can be disposed in intimate contact with the vaporizable material 102 such that direct conductive heating of the vaporizable material 102 of the vaporizable material insert 120 occurs from within a mass of the vaporizable material 102, as opposed to only by conduction inward from walls of the heating chamber (e.g., an oven and/or the like). In some embodiments, the heating element 141 can be a part of the vaporizer body 110 (e.g., part of the durable or reusable part of the vaporizer 100), as shown in FIG. 1.

In some embodiments, the heating element 141 can be a part of the vaporizable material insert 120 (e.g., part of the disposable part of the vaporizer 100). For example, the vaporizable material insert 120 can include one or more vaporizable material contacts that mate with one or more vaporizer body contacts (e.g., positioned along the vaporizable material insert receptacle 118) for providing an electrical conductive pathway between the power source 112 of the vaporizer body 110 and the heating element 141 of the vaporizer material insert 120.

The heating element 141 can be activated in association with a user puffing (e.g., drawing, inhaling, etc.) on an end and/or mouthpiece of the vaporizer device 100 to cause air to flow from an air inlet, along an airflow path for assisting with forming an inhalable aerosol that can be delivered out through an air outlet in the mouthpiece. Incoming air moving along the airflow path moves over or through the heating element 141 and/or vaporizable material 102 where vaporizable material 102 in the gas phase is entrained into the air. The heating element 141 can be activated via the controller 104, which can optionally be a part of the vaporizer body 110 as discussed herein, causing current to pass from the power source 112 through a circuit including the heating element 141, which can be part of the vaporizer body 110. As noted herein, the entrained vaporizable material 102 in the gas phase can condense as it passes through the remainder of the airflow path such that an inhalable dose of the vaporizable material 102 in an aerosol form can be delivered from the air outlet (for example, the mouthpiece) for inhalation by a user.

Activation of the heating element 141 can be caused by automatic detection of a puff based on one or more signals generated by one or more sensor(s) 113. The sensor 113 and the signals generated by the sensor 113 can include one or more of: a pressure sensor or sensors disposed to detect pressure along the airflow path relative to ambient pressure (or optionally to measure changes in absolute pressure), a motion sensor or sensors (for example, an accelerometer) of the vaporizer device 100, a flow sensor or sensors of the vaporizer device 100, a capacitive lip sensor of the vaporizer device 100, detection of interaction of a user with the vaporizer device 100 via one or more input devices 116 (for example, buttons or other tactile control devices of the vaporizer device 100), receipt of signals from a computing device in communication with the vaporizer device 100, and/or via other approaches for determining that a puff is occurring or imminent.

As discussed herein, the vaporizer device 100 consistent with implementations of the current subject matter can be configured to connect (such as, for example, wirelessly or via a wired connection) to a computing device (or optionally two or more devices) in communication with the vaporizer device 100. To this end, the controller 104 can include communication hardware 105. The controller 104 can also include a memory 108. The communication hardware 105 can include firmware and/or can be controlled by software for executing one or more cryptographic protocols for the communication.

A computing device can be a component of a vaporizer system that also includes the vaporizer device 100, and can include its own hardware for communication, which can establish a wireless communication channel with the communication hardware 105 of the vaporizer device 100. For example, a computing device used as part of a vaporizer system can include a general-purpose computing device (such as a smartphone, a tablet, a personal computer, some other portable device such as a smartwatch, or the like) that executes software to produce a user interface for enabling a user to interact with the vaporizer device 100. In other implementations of the current subject matter, such a device used as part of a vaporizer system can be a dedicated piece of hardware such as a remote control or other wireless or wired device having one or more physical or soft (e.g., configurable on a screen or other display device and selectable via user interaction with a touch-sensitive screen or some other input device like a mouse, pointer, trackball, cursor buttons, or the like) interface controls. The vaporizer device 100 can also include one or more outputs 117 or devices for providing information to the user. For example, the outputs 117 can include one or more light emitting diodes (LEDs) configured to provide feedback to a user based on a status and/or mode of operation of the vaporizer device 100.

In the example in which a computing device provides signals related to activation of the heating element 141, or in other examples of coupling of a computing device with the vaporizer device 100 for implementation of various control or other functions, the computing device executes one or more computer instruction sets to provide a user interface and underlying data handling. In one example, detection by the computing device of user interaction with one or more user interface elements can cause the computing device to signal the vaporizer device 100 to activate the heating element to reach an operating temperature for creation of an inhalable dose of vapor/aerosol. Other functions of the vaporizer device 100 can be controlled by interaction of a user with a user interface on a computing device in communication with the vaporizer device 100.

The temperature of the heating element 141 of the vaporizer device 100 can depend on a number of factors, including an amount of electrical power delivered to the heating element 141 and/or a duty cycle at which the electrical power is delivered, conductive heat transfer to other parts of the vaporizer device 100 and/or to the environment, latent heat losses due to vaporization of the vaporizable material 102, and convective heat losses due to airflow (e.g., air moving across the heating element 141 when a user inhales on the vaporizer device 100). As noted herein, to reliably activate the heating element 141 or heat the heating element 141 to a desired temperature, the vaporizer device 100 may, in some implementations of the current subject matter, make use of signals from the sensor 113 (for example, a pressure sensor) to determine when a user is inhaling. The sensor 113 can be positioned in the airflow path and/or can be connected (for example, by a passageway or other path) to an airflow path containing an inlet for air to enter the vaporizer device 100 and an outlet via which the user inhales the resulting vapor and/or aerosol such that the sensor 113 experiences changes (for example, pressure changes) concurrently with air passing through the vaporizer device 100 from the air inlet to the air outlet. In some implementations of the current subject matter, the heating element 141 can be activated in association with a user's puff, for example by automatic detection of the puff, or by the sensor 113 detecting a change (such as a pressure change) in the airflow path.

The sensor 113 can be positioned on or coupled to (e.g., electrically or electronically connected, either physically or via a wireless connection) the controller 104 (for example, a printed circuit board assembly or other type of circuit board). To take measurements accurately and maintain durability of the vaporizer device 100, it can be beneficial to provide a seal resilient enough to separate an airflow path from other parts of the vaporizer device 100. The seal, which can be a gasket, can be configured to at least partially surround the sensor 113 such that connections of the sensor 113 to the internal circuitry of the vaporizer device 100 are separated from a part of the sensor 113 exposed to the airflow path. Such arrangements of the seal in the vaporizer device 100 can be helpful in mitigating against potentially disruptive impacts on vaporizer components resulting from interactions with environmental factors such as water in the vapor or liquid phases and/or to reduce the escape of air from the designated airflow path in the vaporizer device 100. Unwanted air, liquid or other fluid passing and/or contacting circuitry of the vaporizer device 100 can cause various unwanted effects, such as altered pressure readings, and/or can result in the buildup of unwanted material, such as moisture, errant portions of the vaporizable material 102, etc., in parts of the vaporizer device 100 where they can result in poor pressure signal, degradation of the sensor 113 or other components, and/or a shorter life of the vaporizer device 100. Leaks in the seal can also result in a user inhaling air that has passed over parts of the vaporizer device 100 containing, or constructed of, materials that may not be desirable to be inhaled.

In vaporizers in which the power source 112 is part of a vaporizer body 110 and the heating element 141 is disposed in the vaporizable material insert 120 configured to couple with the vaporizer body 110, the vaporizable material insert 120 and vaporizer 100 may include electrical connection features (e.g., electrical contacts) for completing a circuit that includes the controller 104 (e.g., a printed circuit board, a microcontroller, or the like), the power source 112, and the heating element 141. The circuit completed by these electrical connections can allow delivery of electrical current to the heating element 141 (e.g., resistive heating element) and may further be used for additional functions, such as measuring a resistance of the resistive heating element for use in determining and/or controlling a temperature of the resistive heating element based on a thermal coefficient of resistivity of the resistive heating element.

In some embodiments, the vaporizable material insert receptacle 118 can include all or part of the heating element 141 (e.g., a heating coil, resistive heating element, etc.) that is configured to heat the vaporizable material insert 120 received in the vaporizable material insert receptacle 118, such as for forming the inhalable aerosol. For example, the vaporizable material insert receptacle 118 can include various embodiments of the heating element 141 that are configured to receive and/or be placed in contact with the vaporizable material insert 120. Various embodiments of the heating element 141, the vaporizable material insert receptacle 118, and the vaporizable material insert 120 are described herein for integration within and/or use with a variety of vaporizer bodies 110 for forming inhalable aerosol.

In some implementations, the vaporizable material insert 120 can be configured for insertion in the vaporizable material insert receptacle 118, such as for forming contact between an outer surface of the vaporizable material insert 120 and one or more inner walls of the vaporizable material insert receptacle 118. For example, the vaporizable material insert 120 can have the same or similar shape as the vaporizable material insert receptacle 118. In some embodiments, the vaporizable material insert 120 can include a square or rectangular shape. In some embodiments, the vaporizable material insert 120 can include a circular cross-section and/or cylindrical shape. In some embodiments, the vaporizable material insert 120 can have a non-circular cross section transverse to the axis along which the vaporizable material insert 120 is inserted into the vaporizable material insert receptacle 118. For example, the non-circular cross section can be approximately rectangular, approximately elliptical (e.g., have an approximately oval shape), non-rectangular but with two sets of parallel or approximately parallel opposing sides (e.g., having a parallelogram-like shape), or other shapes having rotational symmetry of at least order two. In this context, approximate shape indicates that a basic likeness to the described shape is apparent, but that sides of the shape in question need not be completely linear and vertices need not be completely sharp. Rounding of both or either of the edges or the vertices of the cross-sectional shape is contemplated in the description of any non-circular cross section referred to herein.

In some implementations, at least one of the one or more inner walls forming the vaporizable material insert receptacle 118 can include the heating element 141 and/or include thermally conductive material. For example, vaporizable material insert 120 configurations in which the vaporizable material 120 forms a sliding fit and/or forms close contact with the vaporizable material insert receptacle 118 can allow for efficient heat transfer between the heating element 141 and the vaporizable material insert 120, thereby causing efficient and effective heating of the vaporizable material 102 of the vaporizable material insert 120.

Furthermore, the vaporizable material insert 120 can include compressed and/or high density configurations of non-liquid vaporizable material 102, which can further contribute to efficient and effective heating and vaporizing of the vaporizable material 102. For example, vaporizable material 102 in a compressed and/or high-density configuration can include a minimal amount of air or pockets of air in the vaporizable material 102 thereby increasing the efficiency and effectiveness of transferring heat along the vaporizable material 102. Such a configuration can allow for reduced power consumption at least because less heating power is needed to effectively heat and vaporize the vaporizable material 102. Additionally, lower heating temperatures can be used to heat the vaporizable material 102 at least because of the improved heating efficiency of the vaporizable material 102, which can also reduce power consumption and formation of hazardous byproducts resulting from heating the vaporizable material at higher temperatures. Various embodiments of the vaporizable material insert 120 are described herein that include the vaporizable material formed in compressed and/or high-density configurations for achieving at least some of the benefits described above.

In some embodiments, the vaporizer device can include a heating system configured to receive and heat various embodiments of the vaporizable material insert for generating inhalable aerosol. For example, the heating system can include an embodiment of the heating element 141 positioned along the vaporizable material insert receptacle 118 (e.g., extending along a center and/or along a side wall of the vaporizable material insert receptacle 118). The heating system can also include at least one compression element (e.g., compression plate) and an airflow pathway. As will be described in greater detail below, the heating system can be configured to receive the vaporizable material insert 120, compress the vaporizable material insert 120 onto at least one heating element 141 (e.g., using at least one compression element), and distribute an inhalable aerosol into one or more airflow pathways for inhalation by a user.

Various embodiments of such heating systems of vaporizable devices 100 are described herein that provide a number of benefits, including evenly distributing heat through the vaporizable material 102 of the vaporizable material insert 120. This can result in improved inhalable aerosol generation, less energy and/or lower average temperatures required to form inhalable aerosol, and efficient and effective consumption of the vaporizable material 102.

In some embodiments, the heating system of the vaporizer device 100 is configured to heat a non-liquid combustible material, such as tobacco. For example, the vaporizer body 110 can include one or more compartments or vaporizable material insert receptacles 118 that each accept at least one vaporizable material insert 120 configured to be heated by one or more heating elements 141 thereby generating an inhalable aerosol.

In some embodiments, the heating system may further include at least one compression feature, such as a compression plate, that is configured to compress the vaporizable material insert 120 against the heating element 141. One or more airflow pathways can extend through each vaporizable material insert receptacle 118, including around and/or through the vaporizable material insert 120 positioned within a respective vaporizable material insert receptacle 118.

In some embodiments, the vaporizable material insert 120 may include a non-vapor permeable barrier (such as tobacco paper) configured to contain vaporizable material 102 and protect the heating element 141 from vapor deposits, therefore cleaning of the heating element 141 after use may not be required. Various embodiments of a heating system and vaporizable material inserts 120 are described in greater detail below.

Figure 2A:
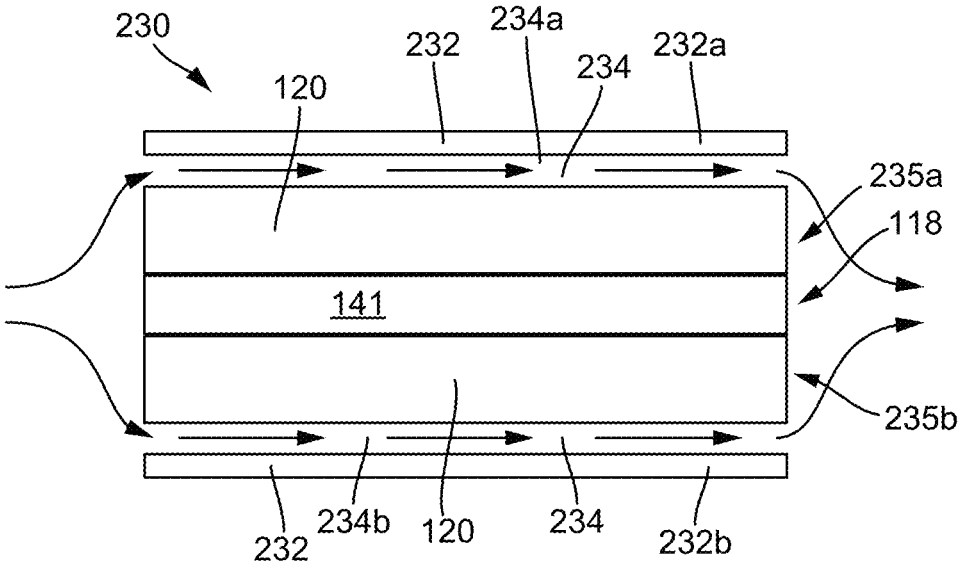
FIG. 2A illustrates a side schematic view of a an embodiment of a heating system included in an embodiment of the vaporizer device of FIG. 1.

FIG. 2A illustrates an embodiment of a heating system 230 of an embodiment of the vaporizer device 100. The heating system 230 can be configured for use with one or more vaporizable material inserts 120. As shown in FIG. 2A, the heating system 230 of the vaporizer device 100 can include a vaporizable material insert receptacle 118 with a heating element 141 positioned within the vaporizable material insert receptacle 118.

In some embodiments, the heating element 141 can couple to a power source 112 at a first end of the vaporizable material insert receptacle 118 and extend along a length of a center of the vaporizable material insert receptacle 118, as shown in FIG. 2A. In some embodiments, the vaporizable material insert receptacle 118 can include two channels 235 (e.g., a first channel 235*a* and a second channel 235*b*) each extending along opposing sides of the heating element 141. For example, the first and second channels 235*a* and 235*b* can each provide a space to insert a vaporizable material insert 120, as well as form a part of an airflow pathway 234. As such, the heating element 141 can heat the vaporizable material inserts 120 positioned in the first and second channels 235*a* and 235*b*, thereby forming an aerosol that can be drawn into and along the airflow pathways 234 extending along the first and second channels 235*a* and 235*b* for inhalation by a user.

In some embodiments, the first and second channels 235*a* and 235*b* can each be configured to accept a vaporizable material insert 120 for heating. After use, the first and second channels 235*a* and 235*b* can each be configured to allow any remaining debris or parts of the vaporizable material inserts 120 to be removed. For example, the vaporizable material insert receptacle 118 can be configured to include an opening along at least one end of the vaporizable material insert receptacle 118 to allow vaporizable material inserts 120 to be inserted therein, such as into one or both of the first and second channels 235*a* and 235*b*. For example, after the vaporizable material inserts 120 have been inserted into the first and second channels 235*a* and 235*b* of the vaporizable material insert receptacle 118, the heating element 141 can be activated to form aerosol for inhalation by a user.

The vaporizable material inserts 120 can include a variety of configurations and include one or more vaporizable materials 102. For example, the vaporizable material inserts 120 can include tobacco. Various other embodiments are within the scope of this disclosure. Furthermore, the vaporizable material inserts 120 can include similar or different shapes and/or sizes, as well as the same or different vaporizable material 102.

As shown in FIG. 2A, the heating system 230 can include one or more compression elements or plates 232 positioned along opposing sides of the vaporizable material insert receptacle 118. For example, the heating system 130 can include a first compression plate 232*a* positioned adjacent the first channel 235*a* and a second compression plate 232*b* positioned adjacent the second channel 235*b*. The compression plates 232 can be configured to move towards each other, thereby compressing the vaporizable material inserts 120 positioned in the first and second channels 235*a* and 235*b* towards the heating element 141 positioned between the first and second channels 235*a* and 235*b*.

For example, the compression plates 232 may compress the vaporizable material inserts 120 against the heating element 141 to improve thermal contact for achieving efficient and effective thermal energy transfer from the heating element 141 to the vaporizable material 102 of the vaporizable material inserts 120. The compression plates 232 may include one or more of a variety of features for moving the compression plates 232 towards the heating element 141, thus compressing the vaporizable material inserts 120 against the heating element 141. For example, each compression plate 232 can include a biasing feature that is configured to bias the respective compression plates towards an adjacent vaporizable material insert 120, as well as towards the heating element 141.

As shown in FIG. 2A, the heating system 230 can further include one or more airflow pathways 234 that extend along the vaporizable material insert receptacle 118 and/or through the vaporizable material insert 120. For example, the heating system 230 can include one or more pathways comprising the airflow pathway 234, such as a first airflow pathway 234*a* extending along the first channel 235*a* and a second airflow pathway 234*b* extending along the second channel 235*b*. The first and second airflow pathways 234*a*, 234*b* can maintain separate pathways or merge and/or divert any number of times, including travel along different parts of the vaporizer device 100.

Figure 2B:
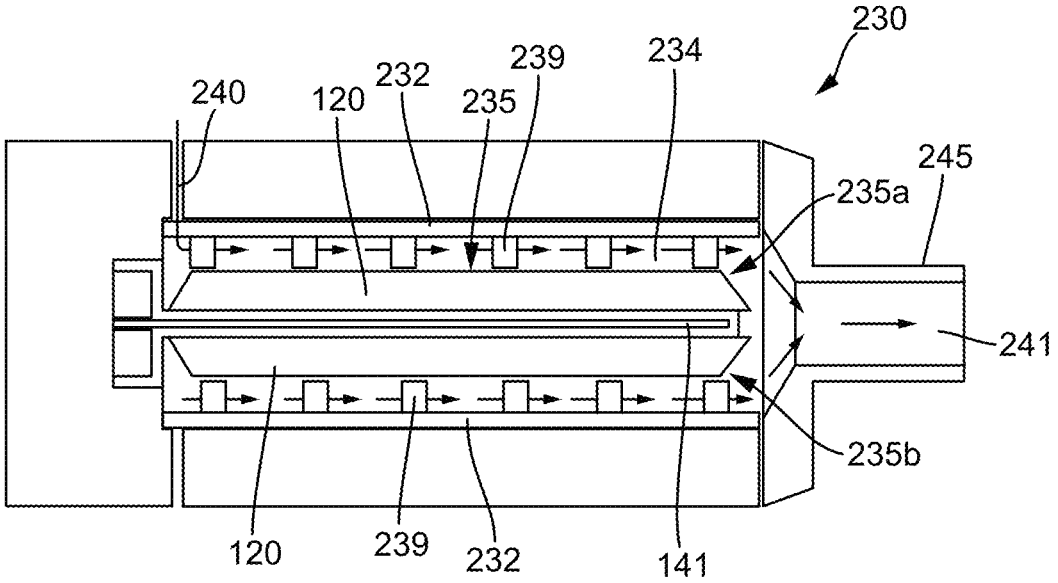
FIG. 2B illustrates a side section view of an embodiment of the heating system of FIG. 2A including protrusions extending from the compression plates.

FIG. 2B illustrates another embodiment of the heating element 230 and can include any number of the features and functions described above with respect to FIG. 2A. As shown in FIG. 2B, the heating element 141 can be positioned between embodiments of the first and second channels 235*a* and 235*b* such that the heating element 141 can contact a side of vaporizable material inserts 120 positioned within the first and second channels 235*a*, 235*b*. As such, when the heating element 141 is activated, the heating element 141 can efficiently and effectively heat the vaporizable material 102 of the vaporizable material inserts 120. The heating element 141 can extend along a length of the vaporizable material inserts 120 thereby efficiently and effectively transferring heat to the vaporizable material inserts 120.

As shown in FIG. 2B, the heating element 141 can include a thin flat blade that can be made out of a thermally conductive and/or electrically resistive material. As shown in FIG. 2B, the heating element 141 can include a first side configured to contact and heat a first vaporizable material insert 120 placed in the first channel 235*a* and a second side configured to contact and heat a second vaporizable material insert 120 placed in the second channel 235*b*. Various embodiments of a heating element 141 having a variety of shapes and sizes are within the scope of this disclosure to allow for efficient and effective heating of one or more vaporizable material inserts.

As shown in FIG. 2B, the heating system 230 can include an embodiment of the compression plates 232, such as the first compression plate 232*a* positioned adjacent the first channel 235*a* and the second compression plate 232*b* positioned adjacent the second channel 235*b*. The compression plates 232 can be configured to move towards each other, thereby compressing the vaporizable material inserts 120 positioned in the first and second channels 235*a* and 235*b* towards the heating element 141 positioned between the first and second channels 235*a* and 235*b*.

As shown in FIG. 2B, each of the compression plates 232 can include one or more protrusions 239 that extend into the vaporizable material insert receptacle 118. The protrusions can include a plurality of raised features that are configured to apply multiple points of compressive force along the vaporizable material for compressing the vaporizable material inserts 120 against the heating element 141. Such compressing can improve thermal contact for achieving efficient and effective thermal energy transfer from the heating element 141 to the vaporizable material 102 of the vaporizable material inserts 120. The compression plates 232 may include one or more of a variety of features for moving the compression plates 232 towards the heating element 141, thus compressing the vaporizable material inserts 120 against the heating element 141. For example, each compression plate 232 can include a compression spring configured to bias the respective compression plates towards an adjacent vaporizable material insert 120, as well as towards the heating element 141. Other features for controlling and assisting the compression plates to provide compressive forces is within the scope of this disclosure.

As shown in FIG. 2B, the heating system 230 can include one or more pathways of the airflow pathways 234 that can extend between an inlet 240 and an outlet 241. As shown in FIG. 2B, the two vaporizable material inserts 120 may each be positioned along opposing sides of the heating element 141 (e.g., having a shape of a thin flat blade) and within the first and second channels 235*a* and 235*b* of the vaporizable material insert receptacle 118. As such, as the heating element 141 can generate heat and increase the temperature of the vaporizable material inserts 120 to cause the production of aerosol. In some embodiments, the aerosol can escape the vaporizable material inserts 120 and travel along the airflow pathway 234 and out the outlet 241 for inhalation by a user. As shown in FIG. 2B, the airflow pathway 234 may pass between the vaporizable material insert 120 and an adjacent compression plate 232, such as between and/or through the protrusions 239. For example, the outlet 241 can be along a mouthpiece 245 configured for allowing the inhalable aerosol to be inhaled by a user.

Figure 3A:
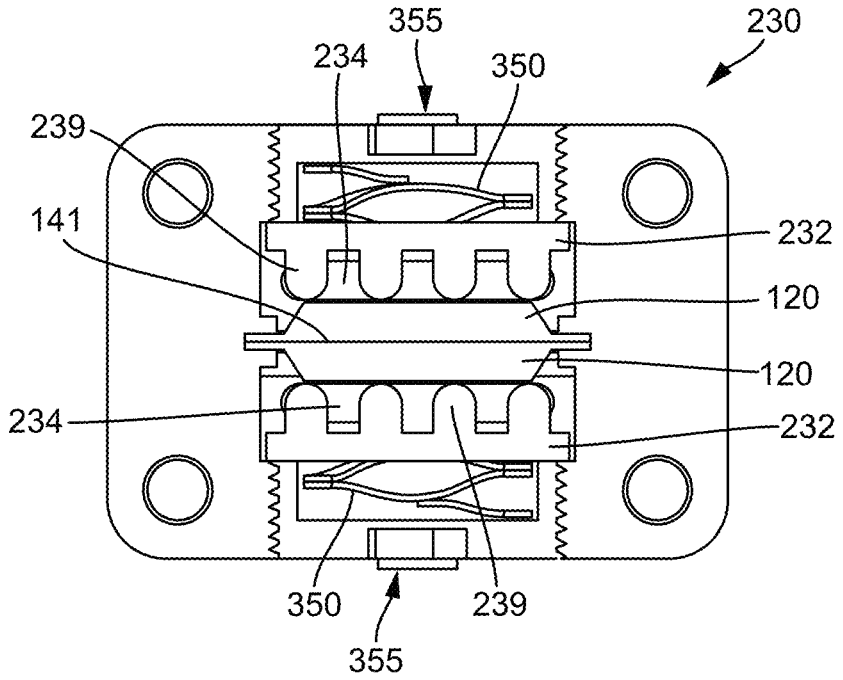
FIG. 3A illustrates a front cross-section view of another embodiment of the heating system of FIG. 2A showing springs positioned adjacent the compression plates.
Figure 3B:
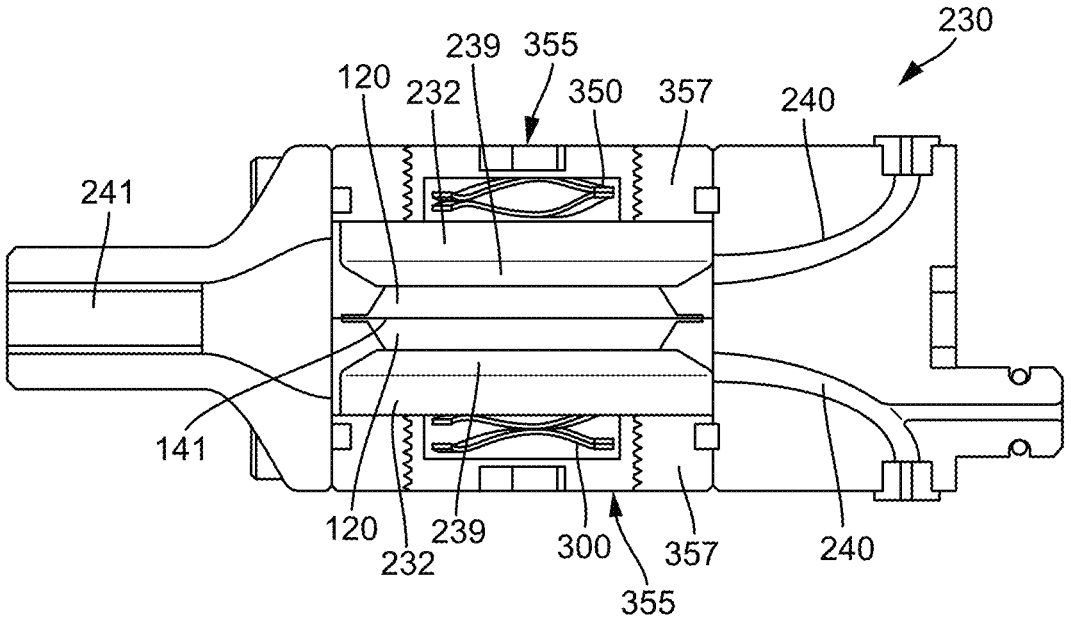
FIG. 3B illustrates a side cross-section view of the heating system of FIG. 3A.

FIGS. 3A and 3B illustrate an embodiment of the heating system 230 that can include any number of the features and functions described above with respect to the heating system 230 of FIGS. 2A and 2B. As shown in FIGS. 3A and 3B, the heating system 230 may include one or more compression plates 232 configured to compress the vaporizable material insert 120 against the heating element 141 in response to pre-loaded springs 350 applying a spring force against an adjacent compression plate 232. As shown in FIGS. 3A and 3B, the heating system 230 can include a pre-loading cap 355 that can be threadably engaged with a part of a housing 357 of the vaporizer body 110. For example, threadably engaging and advancing the pre-loading cap 355 towards the compression plate 232 can increase the pre-loaded spring force, and threadably disengaging and retracting the pre-loading cap 355 away from the housing 357 can reduce the pre-loaded spring force. Other features for adjusting the pre-loaded spring force acting upon an adjacent compression plate 232 are within the scope of this disclosure.

As shown in FIG. 3A, the compression plate 232 may include one or more protrusions 239 that extend towards or into the vaporizable material insert receptacle 118, such as towards the vaporizable material insert 120. As such, the protrusions 239 can be configured to contact the vaporizable material insert 120 thereby allowing the compression plate 232 to compress the vaporizable material insert 120 against the heating element 141 while also providing at least one airflow pathway 234 (e.g., by-pass flow areas) between the inlet 240 and the outlet 241 of the airflow pathway 234.

As shown in FIG. 3B, one or more airflow inlets 240 may be in communication with a first end of the vaporizable material insert receptacle 118 and configured to provide air into the vaporizable material insert receptacle 118 and along the airflow pathways 234. The outlet 241 may be in communication with a distal end of the vaporizable material insert receptacle 118 and configured to allow inhalable aerosol to exit the vaporizer device 100 for inhalation by a user.

Figure 4:
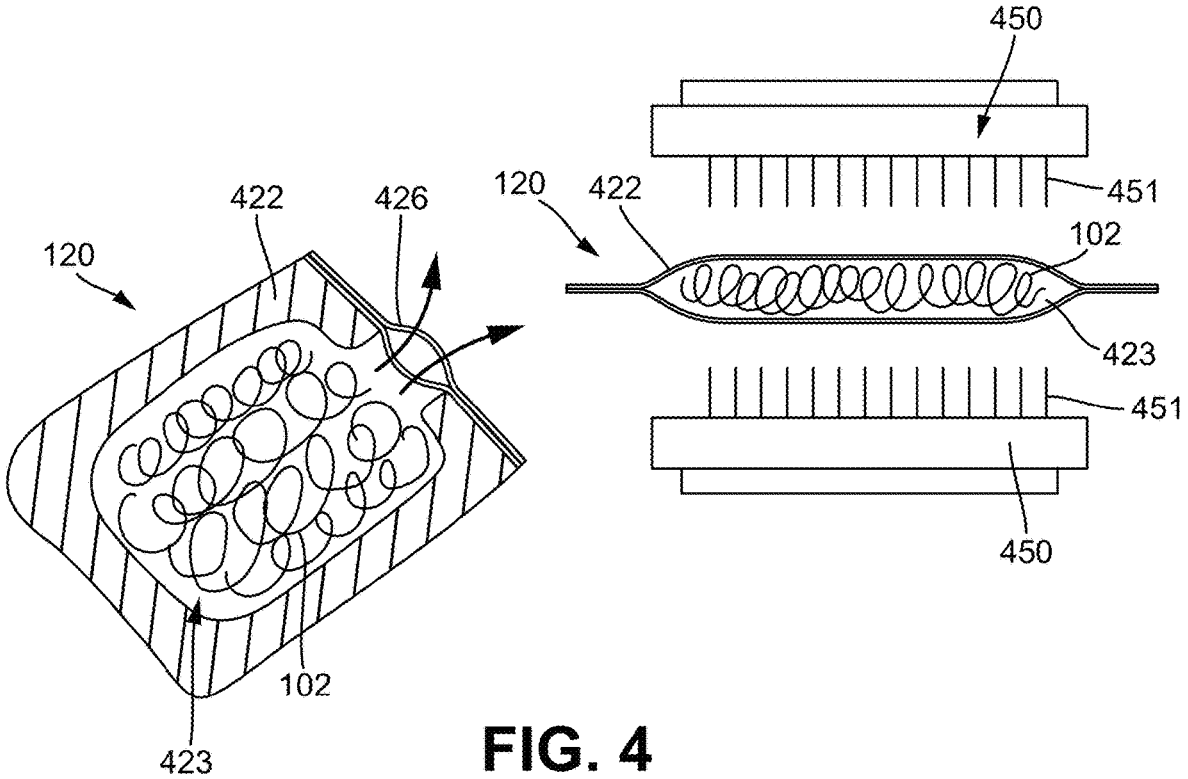
FIG. 4 illustrates an example embodiments and manufacturing process of the vaporizable material insert of FIG. 1.

FIG. 4 illustrates an example manufacturing process for a vaporizable material insert 120 that can be used with the vaporizer body 110 and heating system 230 embodiments described herein. For example, the vaporizable material insert 120 can include an insert housing 422 that forms an inner chamber 423 configured to contain one or more vaporizable materials 102, such as a non-liquid vaporizable material (e.g., tobacco material). For example, the insert housing 422 may comprise one or more materials (e.g., paper, tobacco sheet, etc.) that encompasses a quantity of loose-leaf tobacco (e.g., in ground, shredded, or other forms). The tobacco filling or non-liquid vaporizable material may be soaked with humectants configured to aid in vapor production. In some embodiments, the insert housing 422 can fully or substantially contain the vaporizable material 102.

In some embodiments, the insert housing 422 of the vaporizable material insert 120 can be made out of a tobacco material. The insert housing 422 can be included as part of the consumable that produces vapor that can be inhaled by a user. As such, the heating element 141 can contact and/or heat the insert housing 422 and vaporizable material 102 contained within the insert housing 422, which can result in a favorable heating of the vaporizable material 102 for achieving efficient and effective vapor formation. Such even heating can provide for effective repeated start-and-stop heating of the vaporizable material insert 120.

In some embodiments, the insert housing 422 can be made of a material that prevents passage of air through the insert housing 422 to thereby prevent air from effecting the quality of the vaporizable material 102 contained within the insert housing 422. In some embodiments, the insert housing 422 can include through holes or perforations 426 that allow air to pass through the vaporizable material insert 120. For example, the vaporizable material insert 120 may be completely sealed and at least one through hole can be formed along the insert housing 422 prior to or upon insertion of the vaporizable material insert 120 into the vaporizable material insert receptacle 118 of the vaporizer body 110. Providing a sealed vaporizable material insert can improve and maintain freshness and quality of the vaporizable material 102 within the vaporizable material insert 120.

As shown in FIG. 4, a perforator 450 including an array of needles or sharp objects 451 may be configured to pierce or perforate the vaporizable material insert 120 (e.g., having a non-permeable insert housing 422) to allow the inhalable aerosol generated within the insert housing 422 to exit the vaporizable material insert 120 through the perforations formed along the insert housing 422 and flow into the airflow pathway 234. In some embodiments, perforations may be added to the vaporizable material insert 120 during manufacturing or the vaporizable material insert 120. For example, the perforations 426 can allow heated airflow to enter the vaporizable material insert 120, as well as allow inhalable aerosol to exit the vaporizable material insert 120.

In some embodiments, the vaporizable material insert 120 can be pre-perforated with one or more perforations along the insert housing 422. In some embodiments, perforations 426 can be created along the vaporizable material insert 120 while inserted into the vaporizable material insert receptacle 118 of the heating system 230. In some embodiments, perforations 426 can be formed along a bonding layer or seal of the insert housing 422 of the vaporizable material insert 120. The seal, or bonding layer, of the vaporizable material insert 120 can be configured to open responsive to heat being applied, thereby allowing inhalable aerosol to travel through the opened perforations 426. The opened perforations 426 may permit the inhalable aerosol to escape from the vaporizable material insert 120 and be picked up by the bypass airstream along the airflow pathway 234. Other materials and embodiments of the vaporizable material insert 120 and insert housing 422 are within the scope of this disclosure. For example, some embodiments of the perforated vaporizable material insert 120 can include a heating element 141 and/or thermally conductive material, such as within at least a part of the insert housing 422. In some embodiments, a mouthpiece can be incorporated with the vaporizable material insert 120 to prevent or minimize contact between the inhalable aerosol and the durable portion of the vaporizer body 110.

Figure 5A:
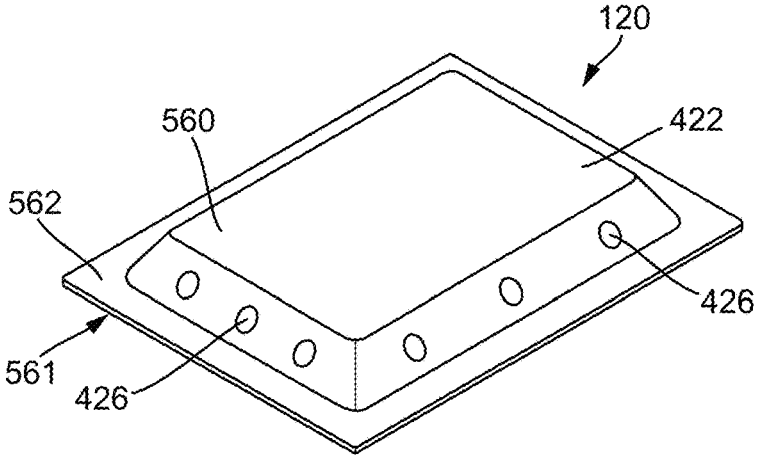
FIGS. 5A-5C illustrate embodiments of vaporizable material inserts each having different venting hole configurations.
Figure 5B:
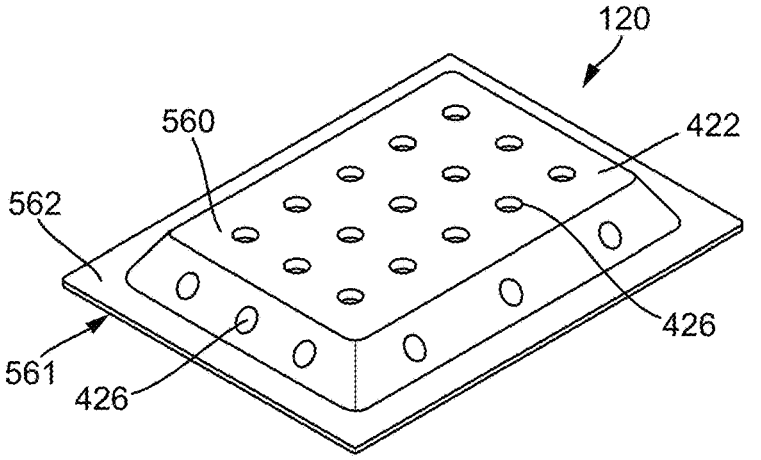
Figure 5C:
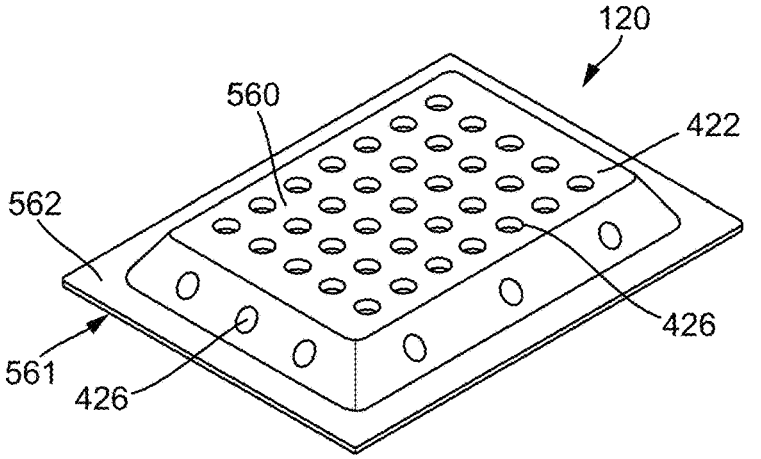

FIGS. 5A-5C illustrate embodiments of the vaporizable material insert 120 including at least one venting hole or perforation 426 along an insert housing 422 of the vaporizable material insert 120. For example, FIGS. 5B and 5C illustrate different placement and densities of perforations 426 along the insert housing 422 of an embodiment of the vaporizable material insert 120. As shown in FIGS. 5A-5C, the vaporizable material insert 120 can include a top surface 560 that is sealed to a bottom surface 561 along a perimeter 562. In some embodiments, the top surface 560 and/or the bottom surface 561 can include one or more perforations 426. In some embodiments, the vaporizable material insert 120 can include a three-dimensional shape and one or more perforations 426 can be included along one or more features (e.g., sides) of the vaporizable material insert 120. The perforations 426 may vary in density and/or the vaporizable material insert 120 may include perforations 426 in a particular formation, such as along one or more sides and/or adjacent the perimeter 562, such as in FIG. 5A.

In some embodiments, the heating system 230 may include an embodiment of the heating element 141 including a flexible material that can conform to the vaporizable material insert 120. For example, the flexible material of the heating element 141 may be configured for efficiently and effectively heating a vaporizable material insert 120 having a cylindrical shape. In other embodiments, the heating element 141 may include a slight angle to the heater surface to increase contact between the heating element surface and the vaporizable material insert 120. Various heating element 141 shapes and configurations are within the scope of this disclosure.

Figure 6A:
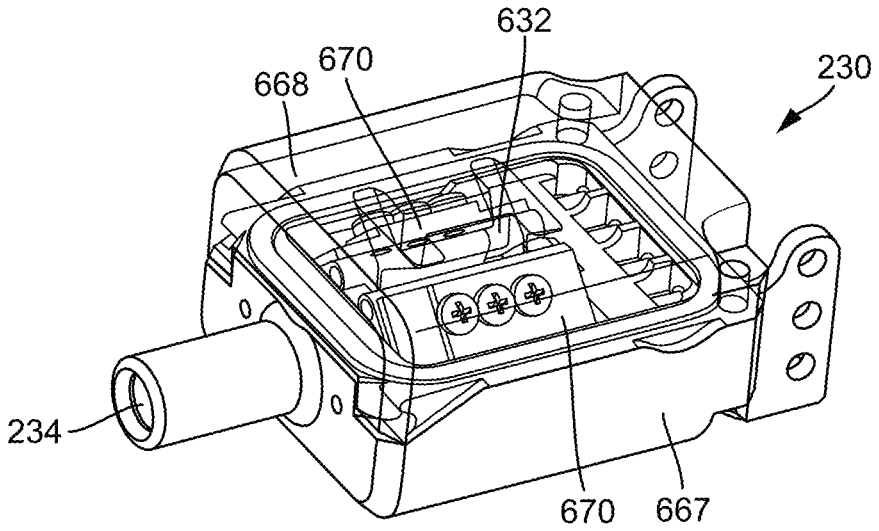
FIG. 6A illustrates a partial perspective view of another embodiment of the heating system of FIG. 2A including a flexible heating element.
Figure 6B:
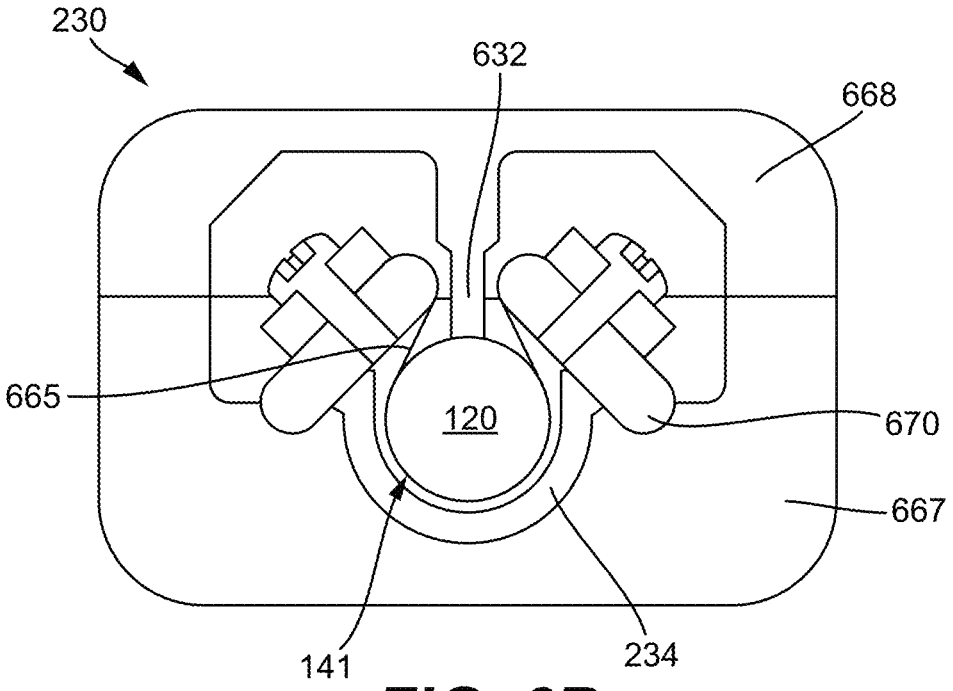
FIG. 6B illustrates a cross-section view of the heating system of FIG. 6A.

FIGS. 6A and 6B illustrate another embodiment of a heating system 230 that can be a part of the vaporizer body 110 of FIG. 1 and configured for receiving and heating a vaporizable material insert 120. Furthermore, the heating system 230 of FIGS. 6A and 6B can include any of the features or functions of the heating system 230 embodiments described herein. As shown in FIGS. 6A and 6B, the heating system 230 can include a base 667 and a lid 668 pivotably coupled to the base 668 (e.g., the lid 668 can pivot between an open and a closed configuration). For example, the base 667 and lid 668 can be integrated in the vaporizer body 110. The base 668 can include a vaporizable material insert receptacle 118 with a heating element 141 including a flexible material 665. The flexible material 665 of the heating element 141 can conform around at least a part of a vaporizable material insert 120, as well as heat the vaporizable material insert 120 for forming an inhalable aerosol. In some embodiments, when the lid 668 forms the closed configuration, the vaporizable material insert receptacle 118 can be sealed such that inhalable aerosol formed in the vaporizable material insert receptacle 118 flows along an airflow pathway 234, such as to a mouthpiece of the vaporizer device 100 for inhalation by a user.

As shown in FIG. 6B, the flexible material 665 of the heating element 141 can conform around a part of an outer surface of a vaporizable material insert 120, such as a vaporizable material insert 120 having a cylindrical shape. In some embodiments, the heating element 141 can include at least one moveable feature 670 (e.g., terminals or busbars) coupled to the flexible material 665. For example, the flexible material 665 can extend between a pair of movable features 670, as shown in FIG. 6B. In some embodiments, the flexible material 665 can include one or more of a copper material, a nichrome material, and a stainless steel material. For example, the flexible material 665 can include a mesh material, such as a copper mesh material. The flexibility of the flexible material 665 can allow at least a part of the heating element 141 to receive and conform around the vaporizable material insert 120, as will be described in greater detail below.

As shown in FIG. 6B, the lid 668 can include a compression feature 632 that extends from a bottom side of the lid 668 such that the compression feature 632 extends towards the base 667 when the lid 668 is in the closed configuration. The compression feature 632 can be positioned along the lid 668 such that when the lid 668 and base 667 form the closed configuration the compression feature 632 can engage and push the vaporizable material insert 120 into the flexible material 665 of the heating element 141. For example, as the lid 668 moves into the closed configuration, the compression feature 632 can push against the vaporizable material insert 120 positioned along the flexible material 665. As the compression feature 632 pushes the vaporizable material insert 120 against the flexible material 665, the flexible material 665 can be pushed down towards the base 667. Such displacement of the flexible material 665 towards the base 667 can cause the movable features 670 to move towards each other, as shown in FIG. 6B. Movement of the movable features 670 towards each other can cause the flexible material 665 to wrap around and further contact the vaporizable material insert 120, as shown in FIG. 6B. As such, when the lid 668 is in the closed configuration, the vaporizable material insert 120 can have the greatest amount of contact with the heating element 141, such as compared to when the lid 668 is in the open configuration. Such greater contact between the vaporizable material insert 120 and the flexible material 665 can increase heating efficiency and effectiveness of the vaporizable material insert 120.

As shown in FIG. 6B, the airflow pathway can extend along the vaporizable material insert receptacle 118, such as between the vaporizable material insert 120 and the base 667. In some embodiments, when the lid 668 is in the open configuration, the movable features 670 can be spaced further apart, such as compared to when the lid is in the closed configuration (e.g., as shown in FIG. 6B) to allow the vaporizable material insert 120 to be inserted into the vaporizable material insert receptacle 118 and placed against the flexible material 665, as well as to allow removal of material from the heating element 141.

Figure 7:
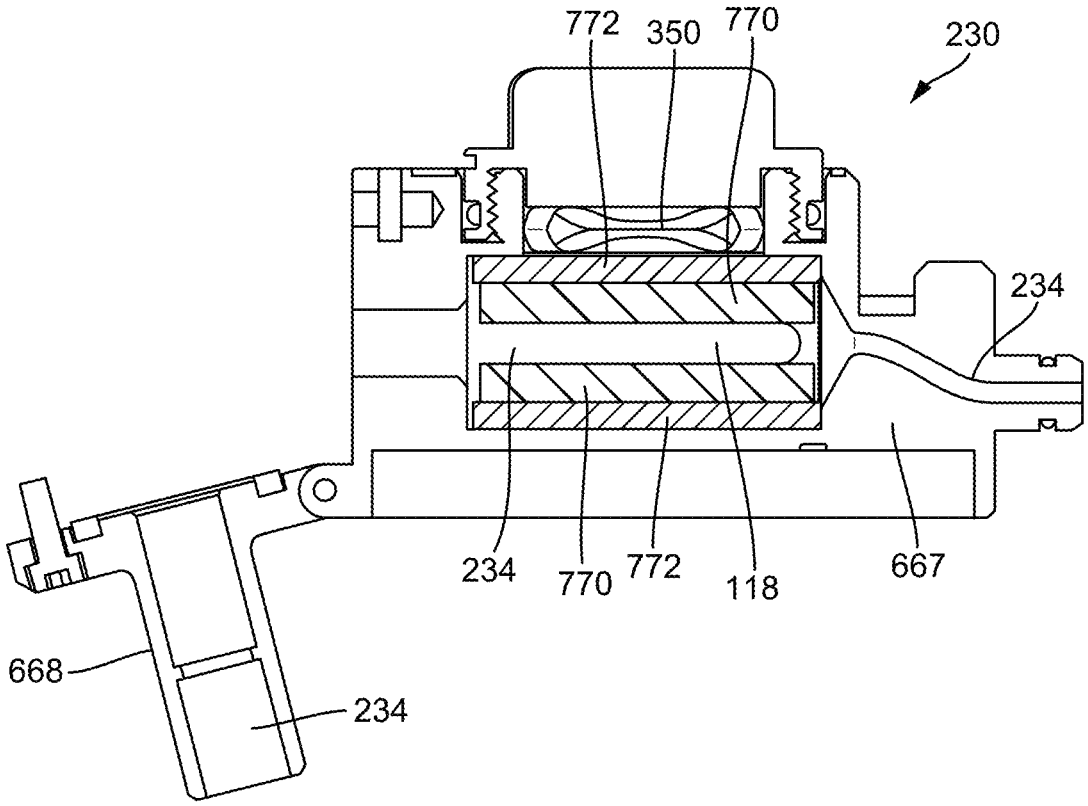
FIG. 7 illustrates another embodiment of the heating system of FIG. 2A including insulation layers.

FIG. 7 illustrates another embodiment of a heating system 230 that can be a part of the vaporizer body 110 of FIG. 1 and configured for receiving and heating a vaporizable material insert 120. Furthermore, the heating system 230 of FIG. 7 can include any of the features or functions of the heating system 230 embodiments described herein. The embodiment of the heating system 230 illustrated in FIG. 7 can include a vaporizable material insert receptacle 118 with at least one heating compression plate 770 positioned within and/or along a side of the vaporizable material insert receptacle 118. As shown in FIG. 7, the vaporizable material insert receptacle 118 may be provided between the heating compression plates 770 and configured to receive a vaporizable material insert 120.

As shown in FIG. 7, the heating system 230 can include two heating compression plates 770 positioned along opposing sides of the vaporizable material insert receptacle 118. The heating compression plates 770 can provide heat and pressure to the vaporizable material insert 120 positioned in the vaporizable material insert receptacle 118. For example, the heating compression plates 770 can include a resistive heater that is in electrical communication with the power source 112 of the vaporizer body 110.

As shown in FIG. 7, the heating system 230 may include at least one insulation layer 772 positioned against a side of the heating compression plate 770 that is opposed to the vaporizable material insert receptacle 118. The insulation layer 772 can include a material that provides insulation and thus assists in directing heat from the heating compression plate 770 towards the vaporizable material insert 120 positioned in the vaporizable material insert receptacle 118, which can further improve the efficiency and effectiveness of heating the vaporizable material insert 120 and forming an inhalable aerosol. As shown in FIG. 7, the heating system 230 can include two insulation layers 772 including one insulation layer 772 positioned adjacent each of the two heating compression plates 770.

As shown in FIG. 7, the heating system 230 can be at least partly contained in an embodiment of the base 667 of the heating system 230, which can be a part of the vaporizer body 110. The heating system 230 can also include an embodiment of the lid 668 that can pivot between an open and closed configuration, such as for allowing a vaporizable material insert 120 to be inserted in the vaporizable material insert receptacle 118. An airflow pathway 234 can extend through the base 667 and lid 668, as well as through the vaporizable material insert receptacle 118.

Various features can be included in the heating system 230 for causing the heating compression plate 770 to provide pressure against the vaporizable material insert 120 to thereby improve contact between the vaporizable material insert 120 and the heating compression plate 770. Such improved contact can achieve efficient and effective heating of the vaporizable material insert 120 for forming an inhalable aerosol. As shown in FIG. 7, the insulation layer 772 may be positioned between the heating compression plate 770 and a spring 350. The spring 350 may be configured to advance and push at least one insulation layer 772 and adjacent heating compression plate 770 toward the vaporizable material insert 120. The insulation plates, heating plates, and/or vaporizable material insert 120 may be arranged parallel, such as for assisting with even contacting and heating of the vaporizable material insert 120. The insulation layer 772 may cover a side of the heating plates and reduce thermal heat transfer to the base of the heating system 230 and/or the vaporizer body 110.

Figure 8A:
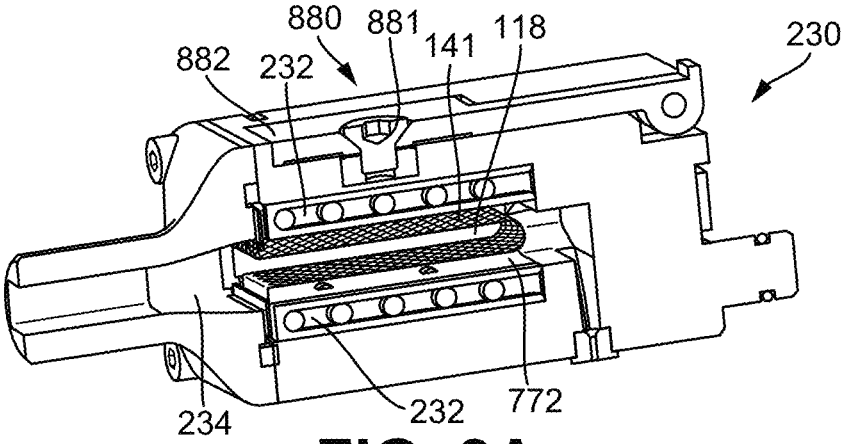
FIG. 8A illustrates a perspective cross-section view of another embodiment of the heating system of FIG. 2A including a compression adjusting feature.
Figure 8B:
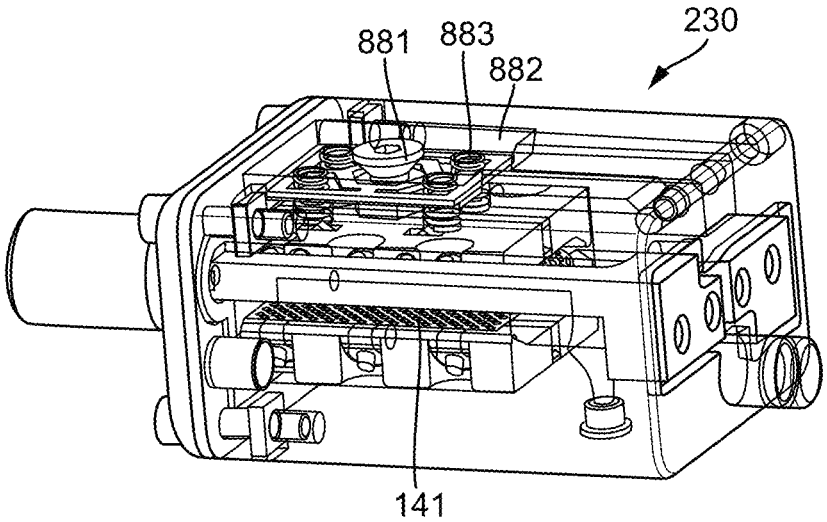
FIG. 8B illustrates a perspective partial view of the heating system of FIG. 8A.
Figure 8C:
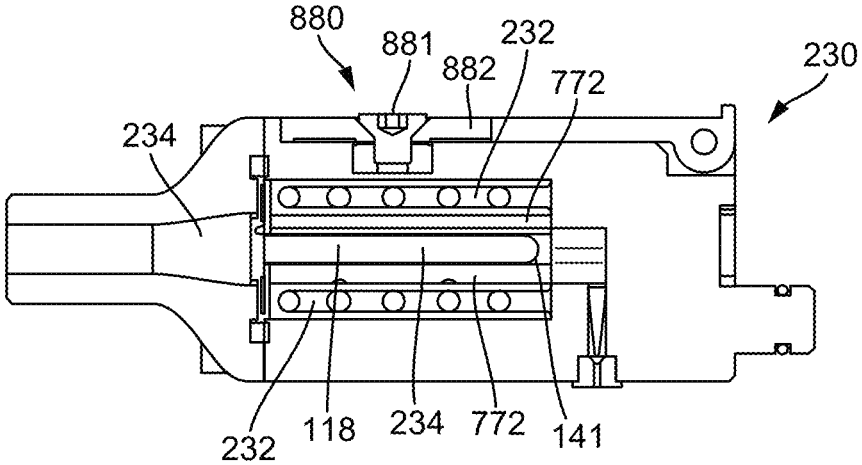
FIG. 8C illustrates a side cross-section view of the heating system of FIG. 8A.

FIGS. 8A-8C illustrate another embodiment of a heating system 230 that can be a part of the vaporizer body 110 of FIG. 1 and configured for receiving and heating a vaporizable material insert 120. Furthermore, the heating system 230 of FIGS. 8A-8C can include any of the features or functions of the heating system 230 embodiments described herein. The embodiment of the heating system 230 illustrated in FIGS. 8A-8C may include a compression adjusting feature 880 that can allow adjustments to be made to the amount of compressive forces applied against the vaporizable material insert 120. For example, the compression adjusting feature 880 can include an adjuster 881 (e.g., screw), an adjustable plate 882, and compression springs 883 (as shown in FIG. 8B). In some embodiments, the adjuster 881 can be threadably engaged with the adjustable plate 883 such that threadably engaging the adjustable plate 883 in a first direction increases the amount of pressure an adjacent compression plate 232 can apply to a vaporizable material insert 120. For example, the compression springs 883 can be positioned between the adjustable plate 882 and the compression plate 232 such that by adjusting the adjuster 881, the compression plate can move towards or away from the compression plate 232 thereby increasing or decreasing, respectively, the spring force applied by the compression springs 883 against the compression plate 232. As such, the amount of pressure or compressive force applied by the compression plate 232 can be adjusted by adjusting the compression adjusting feature 880.

In some embodiments, the heating element 141 can include a mesh material having thermally conductive and/or electrically resistive properties. As shown in FIG. 8A, the heating element 141 can include a bent configuration with opposing ends coupled to an end of the heating system 230 or compression plates 232. For example, the heating element 141 can be formed in the bent configuration to extend at least partly around the vaporizable material insert 120 positioned within the vaporizable material insert receptacle 118 and between opposing extensions of the bent heating element 141. The heating element 118 and airflow pathway 234 can extend through the vaporizable material insert receptacle 118 defined at least partly by the compression plates 232. In some embodiments, as shown in FIG. 8C, the heating system can include at least one insulation plate 772. For example, the insulation plate can be positioned between the heating element 141 and the compression plate 232 to direct heat from the heating element 141 towards the vaporizable material insert 120.

Figure 9A:
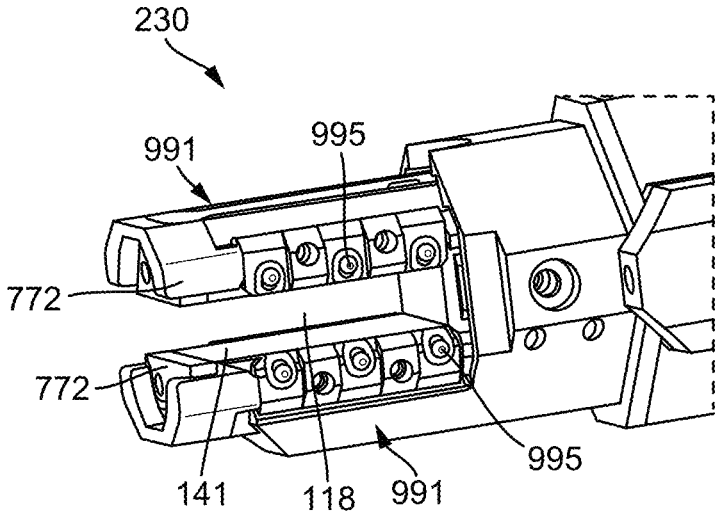
FIG. 9A illustrates a side perspective view of another embodiment of the heating system of FIG. 2A including a pair of moveable jaws.
Figure 9B:
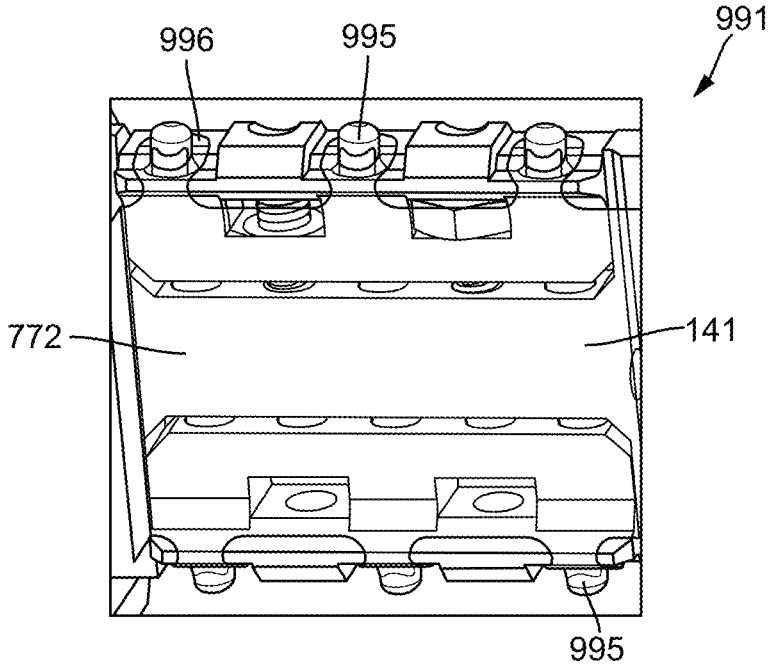
FIG. 9B illustrates a partial top view of an inner surface of one of the pair of moveable jaws of FIG. 9A showing the heating element extending across the inner surface.

FIGS. 9A and 9B illustrate another embodiment of a heating system 230 that can be a part of the vaporizer body 110 of FIG. 1 and configured for receiving and heating a vaporizable material insert 120. Furthermore, the heating system 230 of FIGS. 9A and 9B can include any of the features or functions of the heating system 230 embodiments described herein. The embodiment of the heating system 230 illustrated in FIGS. 9A and 9B can include jaws 991 that can be moved towards and away from each other. For example, the jaws 991 can move toward each other (e.g., due to a mechanical and/or compression force applied to one or both jaws 991) to thereby compress a vaporizable material insert 120 positioned between the jaws 991. As shown in FIG. 9A, each jaw 991 can include an insulation layer 772 that forms an inner portion and/or surface of the jaw 991. For example, the insulation layer can provide a surface along which the heating element 141 can extend along, as shown in FIGS. 9A and 9B. As such, the first and second jaws 991 may advance toward each other to compress and heat the vaporizable material insert 120 positioned therebetween.

In some embodiments, one or more sides of the jaw 991 may include one or more heating element engagement features 995 that allow the heating element 141 to couple thereto. In some embodiments, the heating element 141 may be suspended and/or extending between two or more heating element engagement features 995, as shown in in FIG. 9B. For example, the heating element 141 can include one or more loops 996 that can couple to the heating element engagement feature 995, which can provide thermal conduction and/or electrical conduction for heating the heating element 141. In some embodiments, the element engagement features 995 may be separated and configured to stretch the heating element 141, thus at least partly suspending the heating element 141 within the vaporizable material insert receptacle 118 formed between the jaws 991.

Various embodiments of such heating systems 230 may provide a number of benefits, including ease of manufacturing/assembly, cost effectiveness, maintaining position of the heating element 141, as well as causing the heating element 141 to be held taut and flat by way of engaging with a plurality of heating element features 995.

Figure 10:
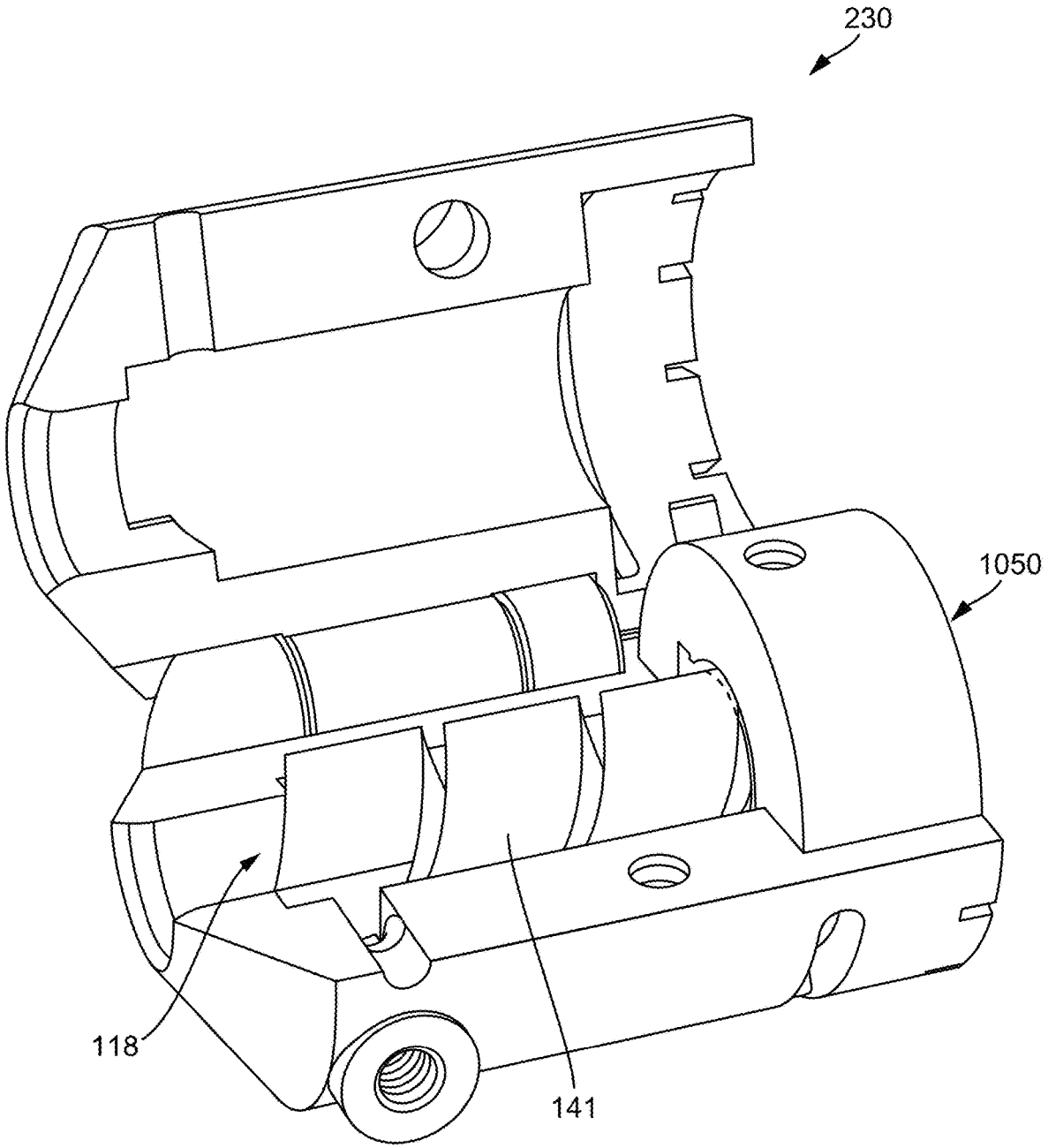
FIG. 10 illustrates a side perspective view of another embodiment of the heating system of FIG. 2A including a helical heating element.

FIG. 10 illustrates another embodiment of a heating system 230 that can be a part of the vaporizer body 110 of FIG. 1 and configured for receiving and heating a vaporizable material insert 120. Furthermore, the heating system 230 of FIG. 10 can include any of the features or functions of the heating system 230 embodiments described herein. As shown in FIG. 10, a heating element 141 can be formed into a torsion spring having a helical shape configured to hold a cylindrically shaped vaporizable material insert 120 therein. For example, the helical heating element 141 can define at least a part of an embodiment of the vaporizable material insert receptacle 118, which can include a cylindrical shape and configured to receive the vaporizable material insert 120 having a cylindrical shape. In some embodiments, a first end of the helical heating element 141 can be twisted in a first direction to cause an internal diameter of the helical heating element 141 to decrease and cause the helical heating element 141 to compress around a vaporizable material insert 120.

In some embodiments, constant compression of the vaporizable material insert 120 can be achieved by using a torsional spring loaded cap 1050 to twist the helical heating element 141 in the first direction. Similarly, the compression of the helical heating element 141 onto the vaporizable material insert 120 may be relieved by twisting the cap 1050 in a second direction. Twisting of the cap in the first direction can cause the helical heating element 141 to decrease in diameter around the inserted vaporizable material insert 120. The cap 1050 may be twisted in the second direction to a loading position, wherein the heating element 141 may have a larger diameter, such as for inserting the vaporizable material insert 120 within the helical heating element 141. Additionally, the cap 1050 may be twisted in the first direction to a vaporization position, wherein the heating element 141 may have a smaller diameter, such as to activate heating of the vaporizable material insert 120. Twisting the helical heating element into a smaller diameter may increase contact between the heating element 141 and the vaporizable material insert 120. In some embodiments, the rotatable cap can include a torsional spring-loaded mechanism that can assist with applying the torsional movement of the rotatable cap 1050.

Various embodiments of such heating systems 230 may provide a number of benefits, including improved thermal transfer between the heating element 141 and the vaporizable material insert 120 (e.g., when cap twisted in first direction), as well as provide ease of removal of remains of a consumed vaporizable material insert 120 (e.g., when cap twisted in second direction).

Figure 11A:
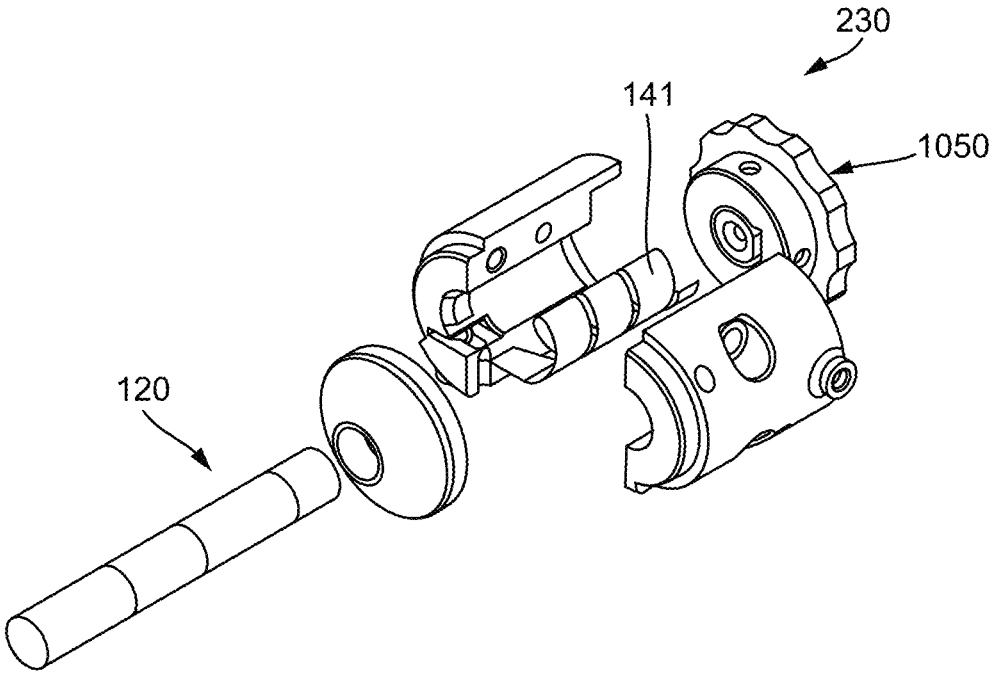
FIG. 11A illustrates a perspective exploded view of the heating system of FIG. 10 and shows an embodiment of the vaporizable material insert configured for use with the heating system of FIG. 10.
Figure 11B:
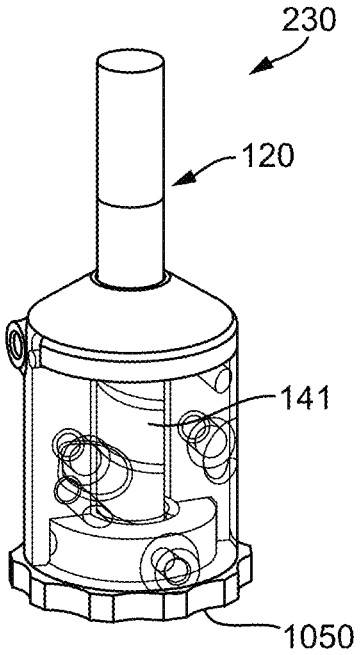
FIG. 11B illustrates a side view of the heating system and vaporizable material insert of FIG. 11A.
Figure 11C:
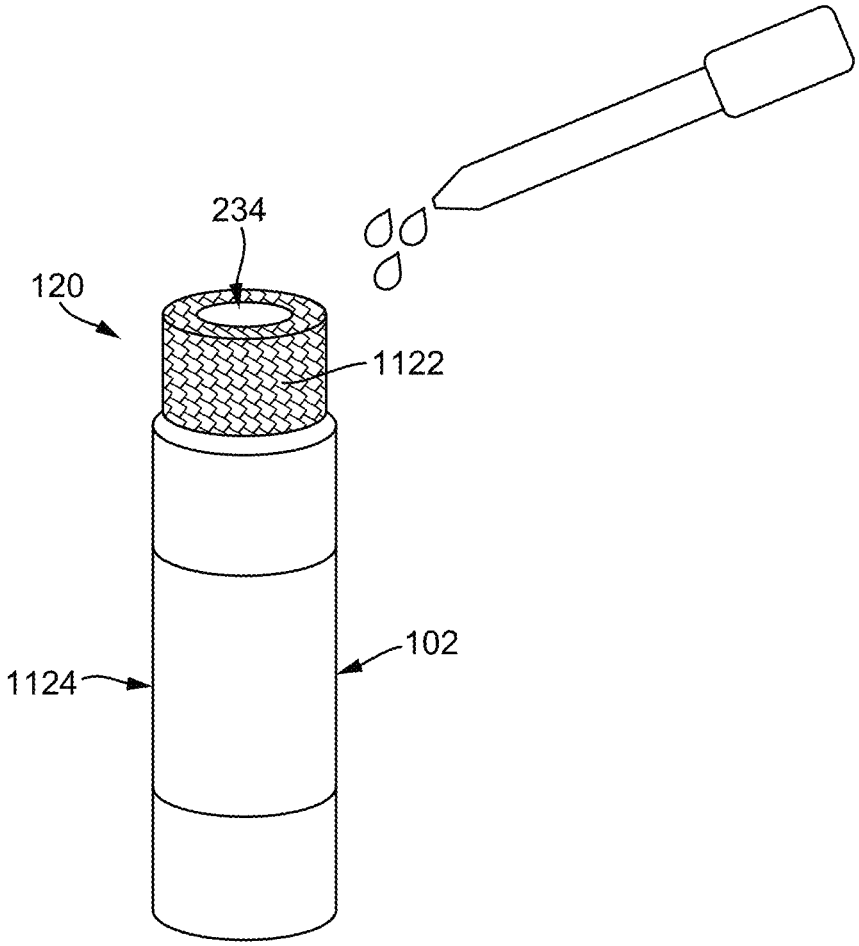
FIG. 11C illustrates a side view of a partial section view of the vaporizable material insert of FIG. 11A.

FIGS. 11A-11C illustrate an embodiment of the heating system 230 described above with respect to FIG. 10 shown with an embodiment of a vaporizable material insert 120 that is configured for use with the heating system 230. As shown in FIG. 11C, the vaporizable material insert 120 can include an elongated cylindrical body that can be sized to couple within the heating element 141 of the heating system 230, as shown in FIGS. 11A and 11B. As described above with respect to FIG. 10 and also shown in FIG. 11A, the heating element 141 can include a torsion spring having a helical shape. As such, the vaporizable material insert 120 can be positioned within the helical shaped heating element 141 thereby allowing the heating element 141 to extend around an outer circumference of the vaporizable material insert 120.

As shown in FIG. 11C, the vaporizable material insert 120 can include a filter portion 1122 positioned upstream of a tobacco or other vaporizable material portion 1124. In some embodiments, the filter portion 1122 can include a wicking material (e.g., made out of cotton) that is formed into a cylindrical, tube shape and inserted into an outer tube (e.g., made out of a paper material). For example, the inner passageway of the wicking material can form an airflow pathway 234 along the filter portion 1122. For example, the airflow pathway 234 can have a diameter of approximately 2 mm to approximately 5 mm. In some embodiments, the wicking material can be saturated with an amount of one or more of a Propylene Glycol (PG) and/or a Vegetable Glycerin (VG) material (e.g., approximately 100 mg of PG and/or VG material). Any number and types of vaporizable materials 102, including liquid vaporizable materials, can be added to the filter portion 1122, such as for forming an inhalable aerosol.

During use, the heating element 141 can heat the vaporizable material insert 120 (e.g., along the outer wall of the vaporizable material insert 120) thus heating the filter portion 1122 and vaporizable material 102. As a result of the filter portion 1122 being heated, the material saturating the filter portion 1122 can be heated thereby forming a volume of inhalable aerosol. This volume of inhalable aerosol formed from the material saturating the filter portion 1122 can form and/or collect in the airflow pathway 234 of the filter portion 1122. This volume of inhalable aerosol formed and/or collected in the airflow pathway 234 of the filter portion 1122 can then be passed through the vaporizable material 102 contained in the vaporizable material portion 1124 and combine with inhalable aerosol formed from the heated vaporizable material 102 (e.g., tobacco material). The combined inhalable aerosols can then be inhaled by a user.

One benefit of the airflow pathway 234 along the filter portion 1122 can allow for less resistance against airflow along the vaporizable material insert 120. This can provide an improved experience for a user inhaling the combined inhalable aerosol (e.g., requires less suction), such as compared to a filter portion 1122 that does not include an airflow pathway 234 and, instead, requires airflow to travel through the wicking material or filter of the filter portion 1122 (e.g., requiring more suction). Other vaporizable material insert 120 configurations that include an airflow pathway through the filter portion 1122 are within the scope of this disclosure, including additional embodiments described herein.

Figure 12:
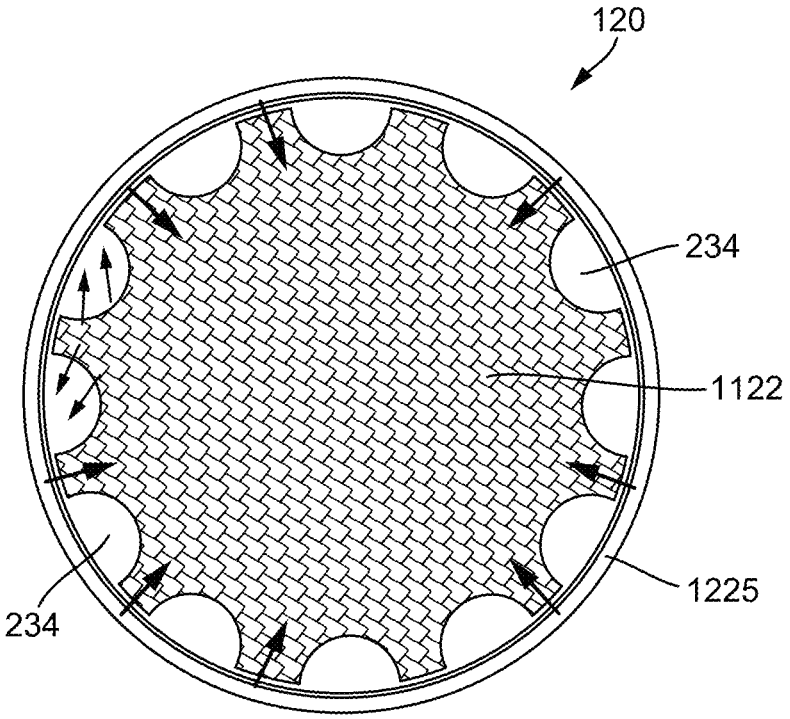
FIG. 12 illustrates a cross section view of another embodiment of the vaporizable material insert including a plurality of airflow pathways along a filter portion of the vaporizable material insert.

FIG. 12 illustrates another embodiment of a vaporizable material insert 120, such as similar to the vaporizable material insert 120 in FIG. 11C, with a plurality of airflow pathways 234 extending along the filter portion 1122. As shown in FIG. 12, the plurality of airflow pathways 234 along the filter portion can be formed along an outer perimeter of a porous or wicking material (e.g., cotton) of the filter portion 1122 thus forming the plurality of airflow pathways 234 between the wicking material and an outer tube 1225 (e.g., made out of paper material and/or thermally conductive material) of the vaporizable material insert 120. As such, the heating element 141 of the heating system 230 can contact the outer tube 1225 and heat the filter portion 1122, thereby heating vaporizable material saturating the wicking material of the filter portion 1122. Inhalable aerosol formed as a result of heating of the filter portion 1122 can be formed in and/or drawn into the plurality of airflow pathways 234, which can then pass through vaporizable material 102 (e.g., tobacco) downstream from the filter portion 1122, as described above.

Figure 13:
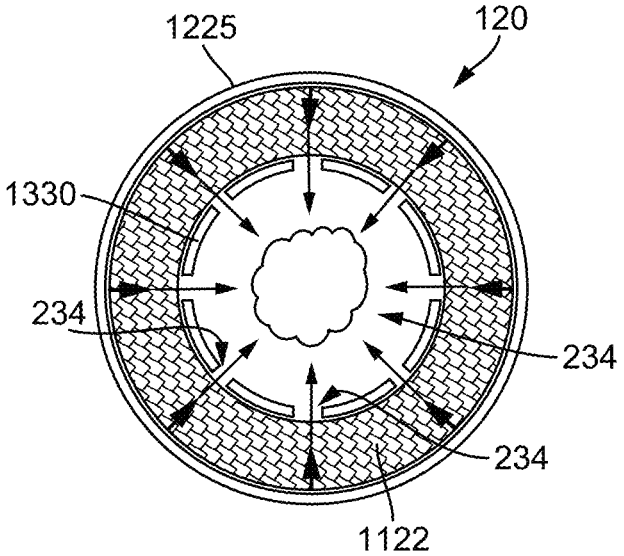
FIG. 13 illustrates a cross section view of another embodiment of the vaporizable material insert including a radially perforated inner tubing.

FIG. 13 illustrates another embodiment of a vaporizable material insert 120, such as similar to the vaporizable material insert 120 in FIG. 11C, with an airflow pathway 234 extending along a center of the filter portion 1122. As shown in FIG. 13, the filter portion 1122 can include a porous or wicking material, or porous medium (e.g., cotton), positioned between an outer tube 1225 (e.g., made out of a paper material and/or thermally conductive material) and a radially perforated tubing 1330 (e.g., made out of an aluminum material). For example, the plurality of perforations 1332 radially along the perforated tubing 1330 can provide airflow passageways 234 for inhalable aerosol formed from material saturating the wicking material of the filter portion 1122 to efficiently flow into the airflow pathway 234 for inhalation by a user. As such, the heating element 141 of the heating system 230 can contact the outer tube 1225 and heat the filter portion 1122, thereby heating material saturating the wicking material of the filter portion 1122. Inhalable aerosol formed as a result of such heating of the filter portion 1122 can be formed and/or collected in the airflow pathway 234, which can then pass through vaporizable material 102 (e.g., tobacco) downstream from the filter portion 1122, as described above.

Figure 14:
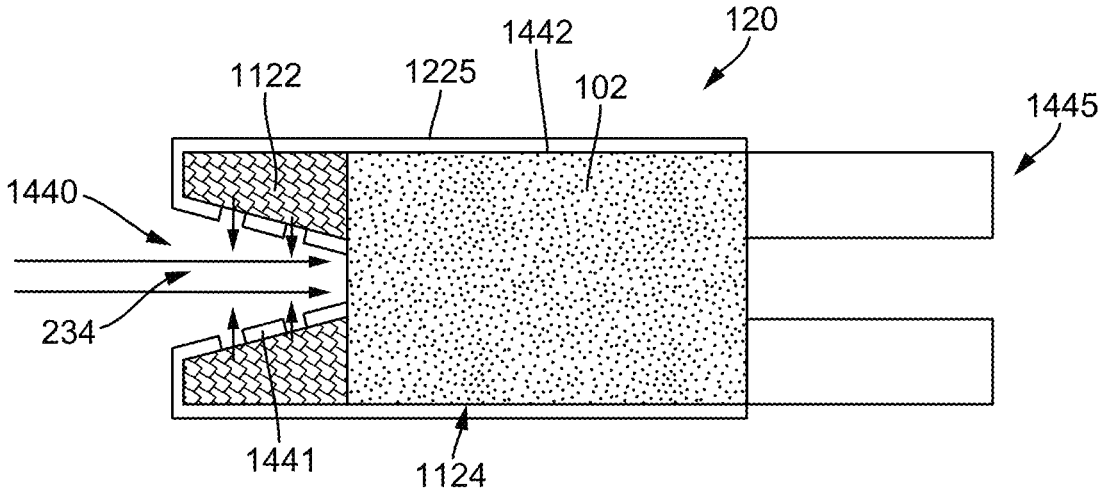
FIG. 14 illustrates a partial cross-section view of another embodiment of the vaporizable material insert including an integrated heating element.

FIG. 14 illustrates another embodiment of a vaporizable material insert 120, such as similar to the vaporizable material inserts 120 in FIGS. 11C and 13, with a tapered airflow pathway 1440 extending along a center of the filter portion 1122. For example, the tapered airflow pathway 1440 can taper in the direction of airflow along the filter portion 1122, as shown in FIG. 14. In some embodiments, the vaporizable material insert can include one or more integrated heating elements, such as a primary heating element 1442 and/or a secondary heating element 1441, as shown in FIG. 14. As also shown in FIG. 14, the filter portion 1122 can include a porous or wicking material, or porous medium (e.g., cotton), positioned between an embodiment of the outer tube 1225 (e.g., made out of a paper material and/or thermally conductive material) and a radially perforated secondary heating element 1441 (e.g., made out of a thermally conductive and/or electrically resistive material). For example, the plurality of perforations radially along the secondary heating element 1441 can provide passageways for inhalable aerosol formed from material saturating the wicking material to efficiently flow into the airflow pathway 234. In some embodiments, a primary heating element 1442 can extend around at least a part of an outer portion of the vaporizable material insert 120, such as between the outer tube 1225 and vaporizable material 102 contained in the vaporizable material portion 1124 downstream from the filter portion 1122. As such, inhalable aerosol formed as a result of heating of the filter portion 1122 can be formed and/or collected in the airflow pathway 234, which can then pass through vaporizable material 102 (e.g., tobacco) downstream from the filter portion 1122, which can be heated by the primary heating element 1442.

As shown in FIG. 14, some embodiments of the vaporizable material insert may include electrical contacts 1445 that are in electrical communication with the primary heating element 1442 and/or secondary heating element 1441. The electrical contacts 1445 can be configured for contacting complimenting electrical contacts along the vaporizer body 110. The electrical contacts along the vaporizer body 110 can be in electrical communication with the power source 112, which can provide power for heating the primary heating element 1442 and/or secondary heating element 1441.

Terminology

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments and implementations only and is not intended to be limiting. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the teachings herein. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A heating system of a vaporizer device for generating an inhalable aerosol, the heating system comprising:

a heating element positioned along a vaporizable material insert receptacle configured to receive a vaporizable material insert, the heating element configured to heat the vaporizable material insert for generating the inhalable aerosol;

a compression element for pressing the vaporizable material insert against the heating element, the compression element comprises:

a first compression plate and a second compression plate positioned along opposing sides of the vaporizable material insert receptacle, wherein the first compression plate and the second compression plate are configured to move towards each other to press the vaporizable material insert against the heating element;

a plurality of first protrusions extending from the first compression plate and into the vaporizable material insert receptacle, the plurality of first protrusions configured to apply pressure against the vaporizable material insert;

a plurality of second protrusions extending from the second compression plate and into the vaporizable material insert receptacle, the plurality of second protrusions configured to apply pressure against the vaporizable material insert; and an airflow pathway extending along the vaporizable material insert receptacle for allowing the inhalable aerosol to flow through an outlet of the vaporizer device;

wherein at least one first protrusion and at least one second protrusion are positioned opposite each other.

2. The heating system of claim 1, wherein the vaporizable material insert receptacle comprises two channels extending along opposing sides of the heating element, each of the two channels being configured to receive a vaporizable material insert.

3. The heating system of claim 2, wherein the heating element includes a first side configured to contact and heat a first vaporizable material insert, the heating element including a second side configured to contact and heat a second vaporizable material insert.

4. The heating system of claim 1, wherein a part of the airflow pathway extends between at least two first protrusions, at least two second protrusions, or a combination thereof.

5. The heating system of claim 1, further comprising a spring that applies a spring force against the compression element to assist with pressing the vaporizable material insert against the heating element.

6. The heating system of claim 1, further comprising an insulation layer positioned adjacent a first side of the heating element, the first side of the heating element being opposed to a second side of the heating element defining a part of the vaporizable material insert receptacle.

7. The heating system of claim 1, wherein the heating element includes a helical configuration that is configured to receive a vaporizable material insert having a cylindrical shape.

8. The heating system of claim 1, further comprising a compression adjusting feature that allows an amount of compression force provided by the compression element to be adjusted.

9. The heating system of claim 1, wherein the heating element comprises a flexible material configured to conform to the vaporizable material insert when the vaporizable material insert is pressed against the heating element.

10. The heating system of claim 1, wherein the vaporizable material insert includes an insert housing that contains a vaporizable material.

11. The heating system of claim 1, wherein at least one first protrusion, at least one second protrusion, or a combination thereof extend substantially along a length of the vaporizable material insert receptacle in a longitudinal direction.

12. A vaporizer system for generating an inhalable aerosol, the vaporizer system comprising:

a vaporizable material insert including a vaporizable material; and a vaporizer device comprising:

a heating system comprising:

a heating element positioned along a vaporizable material insert receptacle configured to receive the vaporizable material insert, the heating element configured to heat the vaporizable material insert for generating the inhalable aerosol;

a compression element for pressing the vaporizable material insert against the heating element, the compression element comprises:

a first compression plate and a second compression plate positioned along opposing sides of the vaporizable material insert receptacle, wherein the first compression plate and the second compression plate are configured to move towards each other to press the vaporizable material insert against the heating element;

a plurality of first protrusions extending from the first compression plate and into the vaporizable material insert receptacle, the plurality of first protrusions configured to apply pressure against the vaporizable material insert;

a plurality of second protrusions extending from the second compression plate and into the vaporizable material insert receptacle, the plurality of second protrusions configured to apply pressure against the vaporizable material insert; and an airflow pathway extending along the vaporizable material insert receptacle for allowing the inhalable aerosol to flow through an outlet of the vaporizer device;

wherein at least one first protrusion and at least one second protrusion are positioned opposite each other.

13. A method for generating an inhalable aerosol for inhalation by a user, the method comprising:

receiving a vaporizable material insert including a vaporizable material into a vaporizable material insert receptacle of a vaporizer device;

compressing the vaporizable material insert against a heating element positioned along the vaporizable material insert receptacle with a compression element, wherein the compression element comprises:

a first compression plate and a second compression plate positioned along opposing sides of the vaporizable material insert receptacle, wherein the first compression plate and the second compression plate are configured to move towards each other to press the vaporizable material insert against the heating element;

a plurality of first protrusions extending from the first compression plate and into the vaporizable material insert receptacle, the plurality of first protrusions configured to apply pressure against the vaporizable material insert; and a plurality of second protrusions extending from the second compression plate and into the vaporizable material insert receptacle, the plurality of second protrusions configured to apply pressure against the vaporizable material insert;

wherein at least one first protrusion and at least one second protrusion are positioned opposite each other; and activating the heating element to heat the vaporizable material of the vaporizable material insert to form the inhalable aerosol.

14. The method of claim 13, further comprising:

adjusting a compression force provided by the compression element.

15. The method of claim 14, wherein the vaporizer device comprises a spring that applies the compression force against the compression element.

16. The method claim 14, wherein the vaporizer device comprises a compression adjusting feature that adjusts the compression force.

* * * * *